US011771195B1

(12) United States Patent
Fox

(10) Patent No.: US 11,771,195 B1
(45) **Date of Patent: *Oct. 3, 2023**

(54) MOBILE COLOR AND STYLE APPLICATION DEVICE

(71) Applicant: Alisha Fox, Elkhorn, NE (US)

(72) Inventor: Alisha Fox, Elkhorn, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/575,329

(22) Filed: Jan. 13, 2022

Related U.S. Application Data

(63) Continuation-in-part of application No. 16/840,651, filed on Apr. 6, 2020, now Pat. No. 11,224,279.

(60) Provisional application No. 63/159,264, filed on Mar. 10, 2021, provisional application No. 62/830,116, filed on Apr. 5, 2019.

(51) Int. Cl.
*A45D 19/00* (2006.01)
*A45D 44/04* (2006.01)

(52) U.S. Cl.
CPC ..... *A45D 19/016* (2021.01); *A45D 44/04* (2013.01)

(58) Field of Classification Search
CPC ..... A45D 19/016; A45D 44/04; A45D 44/14; A47B 9/20; A47B 13/023; A47B 13/08; A47B 13/14; A47B 37/00
See application file for complete search history.

(56) References Cited

U.S. PATENT DOCUMENTS 2,112,669 A 3/1938 Ernest
2,353,064 A * 7/1944 Linthicum ..... A45D 44/02 108/1
D216,852 S 3/1970 Farwick
4,606,525 A 8/1986 Lombardi
D301,414 S 6/1989 Maltese
4,979,524 A 12/1990 Anderson
5,267,712 A * 12/1993 Shen ..... F16M 11/2064 396/428
5,564,661 A * 10/1996 Gershon ..... A47B 19/002 248/167
D395,182 S 6/1998 Singleton
5,819,960 A 10/1998 Bonazza
D408,172 S 4/1999 Nobili
6,889,950 B2 5/2005 Evanoff
D734,541 S 7/2015 Petruccelli
(Continued)

FOREIGN PATENT DOCUMENTS

DE 102016106175 A1 * 10/2017
FR 2268488 A1 11/1975

*Primary Examiner* — Daniel J Rohrhoff
(74) *Attorney, Agent, or Firm* — Suiter Swantz pc llo

(57) ABSTRACT

A mobile color and style application device is disclosed. The device includes a base. The base includes one or more vertical legs including one or more lockable wheels. The device further includes an adjustable tower coupled to the base. The adjustable tower including one or more tower locks configured to adjust a vertical height of the adjustable tower. The device further includes a plate coupled to the adjustable tower. The plate includes one or more tower locks configured to adjust a tilt angle of the plate. The device further includes one or more platforms. The one or more platforms are configured to couple to a portion of the plate via a quick-connect coupling mechanism. The one or more platforms include one or more cut-outs. The one or more cut-outs are configured to conform to a portion of at least one of a neck or a head of a user.

19 Claims, 21 Drawing Sheets

(56) References Cited

U.S. PATENT DOCUMENTS

| | | | | |
|---|---|---|---|---|
| D815,463 | S | 4/2018 | Kobayashi | |
| 10,388,193 | B1 * | 8/2019 | Wriedt | A47C 7/00 |
| D898,291 | S | 10/2020 | Taylor et al. | |
| 11,224,279 | B2 * | 1/2022 | Fox | A47B 31/00 |
| 11,284,710 | B1 * | 3/2022 | Guo | A47B 41/02 |
| 11,348,493 | B2 * | 5/2022 | Wriedt | G09F 15/0012 |
| 2003/0094123 | A1 * | 5/2003 | Ulmer | A47B 13/023 108/10 |
| 2005/0284011 | A1 * | 12/2005 | Todd | G09F 7/04 40/607.05 |
| 2007/0221813 | A1 | 9/2007 | Blum et al. | |
| 2019/0344312 | A1 | 11/2019 | Palmer | |
| 2020/0015453 | A1 | 1/2020 | Escalante et al. | |
| 2020/0077788 | A1 | 3/2020 | Albers et al. | |
| 2020/0315340 | A1 * | 10/2020 | Schneider | A63B 21/4033 |
| 2021/0100337 | A1 * | 4/2021 | Taylor | A47B 13/023 |
| 2022/0071384 | A1 * | 3/2022 | Giery | A47B 3/0818 |

* cited by examiner

MOBILE COLOR AND STYLE APPLICATION DEVICE

CROSS-REFERENCE TO RELATED APPLICATIONS

The present application is related to and claims the benefit of the earliest effective filing date from the following applications: The present application constitutes a continuation-in-part of U.S. patent application Ser. No. 16/840,651, filed Apr. 6, 2020; which is a regular (non-provisional) patent application of U.S. Provisional Application No. 62/830,116, filed Apr. 5, 2019; and claims the benefit under 35 U.S.C § 119 of U.S. Provisional Application No. 63/159,264 filed Mar. 10, 2021; all of which are incorporated herein by reference in the entirety.

TECHNICAL FIELD

The present invention generally relates to the field of hair stylist tools, and more particularly to a mobile color and style application device.

BACKGROUND

Coloring services have become extremely popular. One particular type of coloring service is a freehand painting of hair by a stylist whereby selective hair strands, or collections of hair strands, may be colored to provide a unique style of highlights, ombre shades, and the like. This type of color service may be referred as a balayage service. It is commonplace to use a freehand board which may include a small, flat surface and a handle portion in order for a stylist to provide the freehand painting of hair. However, the use of a board to perform a freehand painting of hair service requires a substantial amount of time for the stylist to complete the service for a client, which causes a substantial cost to the client. Further, the freehand board must be held in the hand of the stylist. Therefore, it would be desirable to provide a device that cures the shortfalls of the previous approaches identified above.

SUMMARY

A mobile color and style application device is disclosed. In embodiments, the device includes a base, wherein the base includes one or more vertical legs, wherein the one or more legs include one or more lockable wheels. In embodiments, the device further includes an adjustable tower coupled to the base, wherein the adjustable tower including one or more tower locks configured to adjust a vertical height of the adjustable tower. In embodiments, the device further includes a plate coupled to the adjustable tower, wherein the plate includes one or more tower locks configured to adjust a tilt angle of the plate. In embodiments, the device further includes one or more platforms, wherein the one or more platforms are configured to couple to a portion of the plate via a quick-connect coupling mechanism, wherein the one or more platforms include one or more cut-outs, wherein the one or more cut-outs are configured to conform to a portion of at least one of a neck or a head of a user, wherein the quick-connect coupling mechanism includes one or more magnetic connectors, wherein the one or more platforms include a recessed area on a bottom surface of the one or more platforms, wherein the one or more platforms include the one or more magnetic connectors in the recessed area of the bottom surface of the one or more platforms.

A mobile color and style application device is disclosed. In embodiments, the device includes a base, wherein the base includes one or more vertical legs, wherein the one or more legs include one or more lockable wheels. In embodiments, the device further includes an adjustable tower coupled to a portion of the base, wherein the adjustable tower including one or more tower locks configured to adjust a vertical height of the adjustable tower. In embodiments, the device further includes a plate coupled to the adjustable tower, wherein the plate includes one or more tower locks configured to adjust a tilt angle of the plate. In embodiments, the device further includes one or more platforms, wherein the one or more platforms are configured to couple to a portion of the plate via a quick-connect coupling mechanism, wherein the one or more platforms include one or more cut-outs, wherein the one or more cut-outs are configured to conform to a portion of at least one of a neck or a head of a user, wherein the quick-connect coupling mechanism includes one or more magnetic connectors, wherein the one or more platforms include a recessed area on a bottom surface of the one or more platforms, wherein the one or more platforms include the one or more magnetic connectors in the recessed area of the bottom surface of the one or more platforms. In embodiments, the device further includes a removable overlay configured to removably couple to a portion of the one or more platforms.

A mobile color and style application device is disclosed. In embodiments, the device includes a base, wherein the base includes one or more vertical legs, wherein the one or more legs include one or more lockable wheels. In embodiments, the device further includes an adjustable tower coupled to a portion of the base, wherein the adjustable tower including one or more tower locks configured to adjust a vertical height of the adjustable tower. In embodiments, the device further includes a plate coupled to the adjustable tower, wherein the plate includes one or more tower locks configured to adjust a tilt angle of the plate. In embodiments, the device further includes one or more platforms, wherein the one or more platforms are configured to couple to a portion of the plate via a quick-connect coupling mechanism, wherein the one or more platforms include one or more cut-outs, wherein the one or more cut-outs are configured to conform to a portion of at least one of a neck or a head of a user, wherein the quick-connect coupling mechanism includes one or more magnetic connectors, wherein the one or more platforms include a recessed area on a bottom surface of the one or more platforms, wherein the one or more platforms include the one or more magnetic connectors in the recessed area of the bottom surface of the one or more platforms, wherein the one or more platforms include one or more holes configured to receive one or more accessories. In embodiments, the device further includes a removable overlay configured to removably couple to a portion of the one or more platforms.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Reference will now be made in detail to the subject matter disclosed, which is illustrated in the accompanying drawings.

It is commonplace to use a freehand board which may include a small, flat surface and a handle portion in order for a stylist to provide freehand hair painting. However, the freehand board must be held in the hand of the stylists. Further, the use of a freehand board to perform a freehand painting of hair service has a number of disadvantages. For example, hair sectioning is less efficient while using a board. By way of another example, a hair stylist has less control because the board is being held in one hand while having to manage color placement and pressure with the other hand. By way of another example, a hair stylist has reduced color control because with only one hand, an unstable surface is used to apply the color. By way of another example, hair stylists are unable to check their work without disturbing color because there is a reduced ability to adjust the color. By way of another example, the application time is increased and there is a risk of compromised hair integrity. By way of a further example, there are limited options for processing because when using the freehand board there is a greater risk of bleeding which affects color precision. Therefore, it would be desirable to provide a device that cures the shortfalls of the previous approaches identified above.

Referring generally to FIGS. 1-18B, a mobile color and style application device is described, in accordance with one or more embodiments of the present disclosure.

Figure 1:
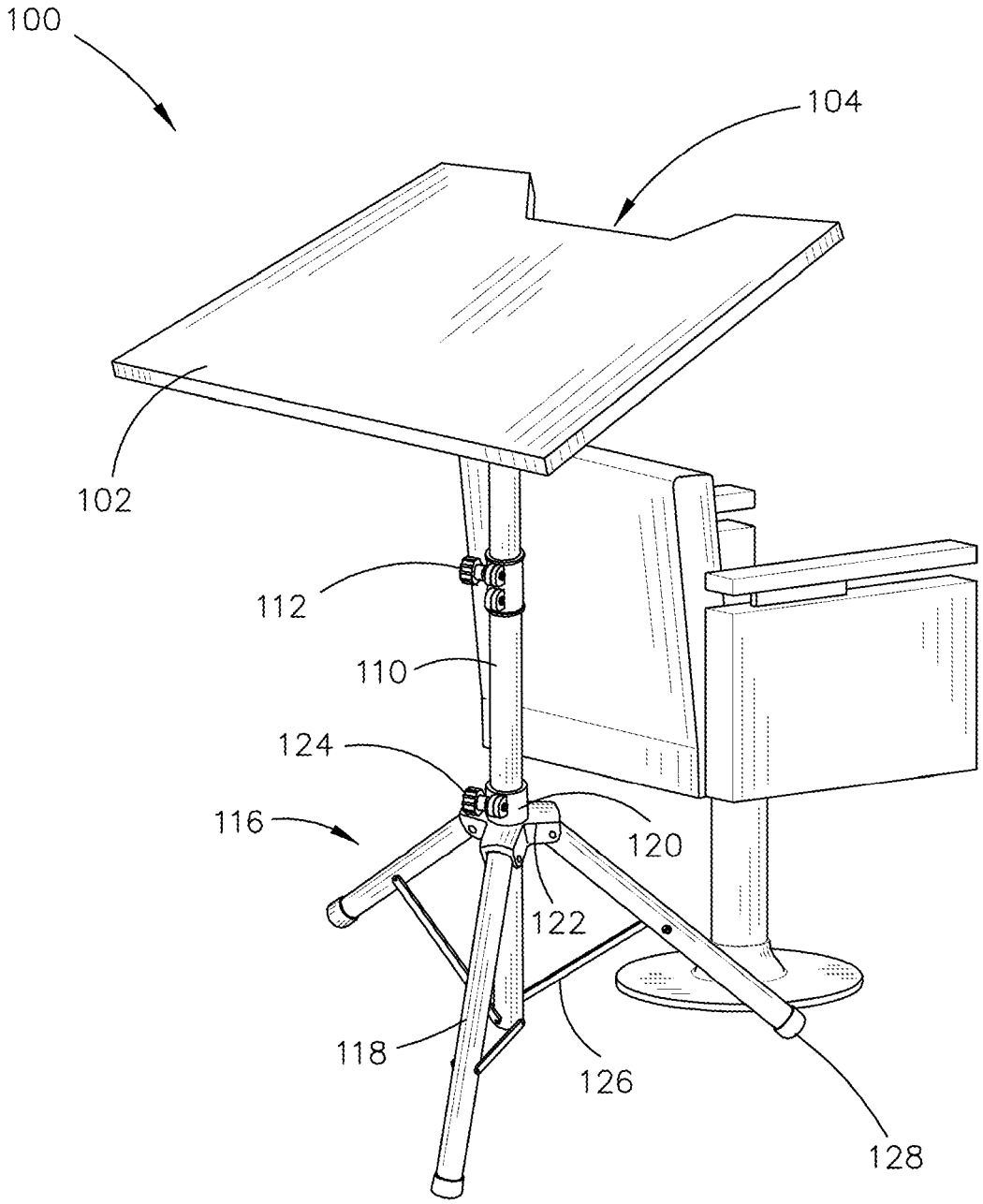
FIG. 1 illustrates a perspective view of a mobile color and style application device, in accordance with one or more embodiments of the present disclosure.

FIG. 1 illustrates a perspective view of a mobile color and style application device 100, in accordance with one or more embodiments of the present disclosure.

In embodiments, the device 100 includes one or more platforms 102. The one or more platforms 102 may be formed of any material known in the art suitable for color processing including, but not limited to, canvas, vinyl, glass, acrylic, melamine, wood, metal, or the like. For example, the device 100 may include one or more acrylic platforms.

In some embodiments, the one or more platforms 102 may include a film or coating. For example, the one or more platforms 102 may include a plastic resin coating. By way of another example, the one or more platforms 102 may include a laminate film. By way of a further example, the one or more platforms 102 may include a melamine resin coating. In this regard, the one or more platforms including the film or coating may allow a stylist to mark up the one or more platforms prior to the coloring process using a dry erase marker to allow a user to visualize a specific look prior to application or to aid the stylist during the coloring process (e.g., act as a template). Further, the one or more platforms 102 formed of melamine, glass, or the like may allow a stylist to mark up the one or more platforms prior to coloring using a dry erase marker.

It is noted herein that the one or more platforms 102 may be any thickness known in the art. For example, the one or more platforms may be 0.25 inches thick. For instance, the one or more acrylic platforms may be 0.25 inches thick. Further it is noted herein that the thickness of the one or more platforms and/or the film or coating may vary.

In some embodiments, the one or more platforms 102 may include a frame. The frame of the platform may include a canvas exterior. The canvas exterior may be formed of any material known in the art including, but not limited to, cotton, linen, polyvinyl chloride (PVC), a combination of such, or the like. The frame of the platform may be formed of any material known in the art including, but not limited to, plastic, wood, metal, or the like.

In some embodiments, the one or more platforms 102 may include one or more graphical representations. For example, the one or more platforms 102 may include, but are not limited to, one or more pieces of artwork, one or more logos, one or more symbols, one or more phrases, one or more designs, or the like. In an example where the one or more platforms are formed of canvas or include a canvas exterior, the stylist may create their own piece of artwork on the one or more platforms 102 when utilizing the device 100 for coloring applications. It is noted herein that the one or more graphical representations of the one or more platforms 102 may be applied to the platform and/or fabricated via any mechanism known in the art including, but not limited to, screen printing, adhesives, color dyes, painting, or the like.

In some embodiments, the one or more platforms 102 may include one or more distance markers. For example, the one or more distance markers (e.g., rulers) may be printed or engraved on the one or more platforms for measurement reference during coloring services. It is noted herein that the one or more distance markers may utilize any system of measurement known in the art including, but not limited to, the metric system, the imperial system, the International System of Units (SI) system, or the like.

Figure 2:
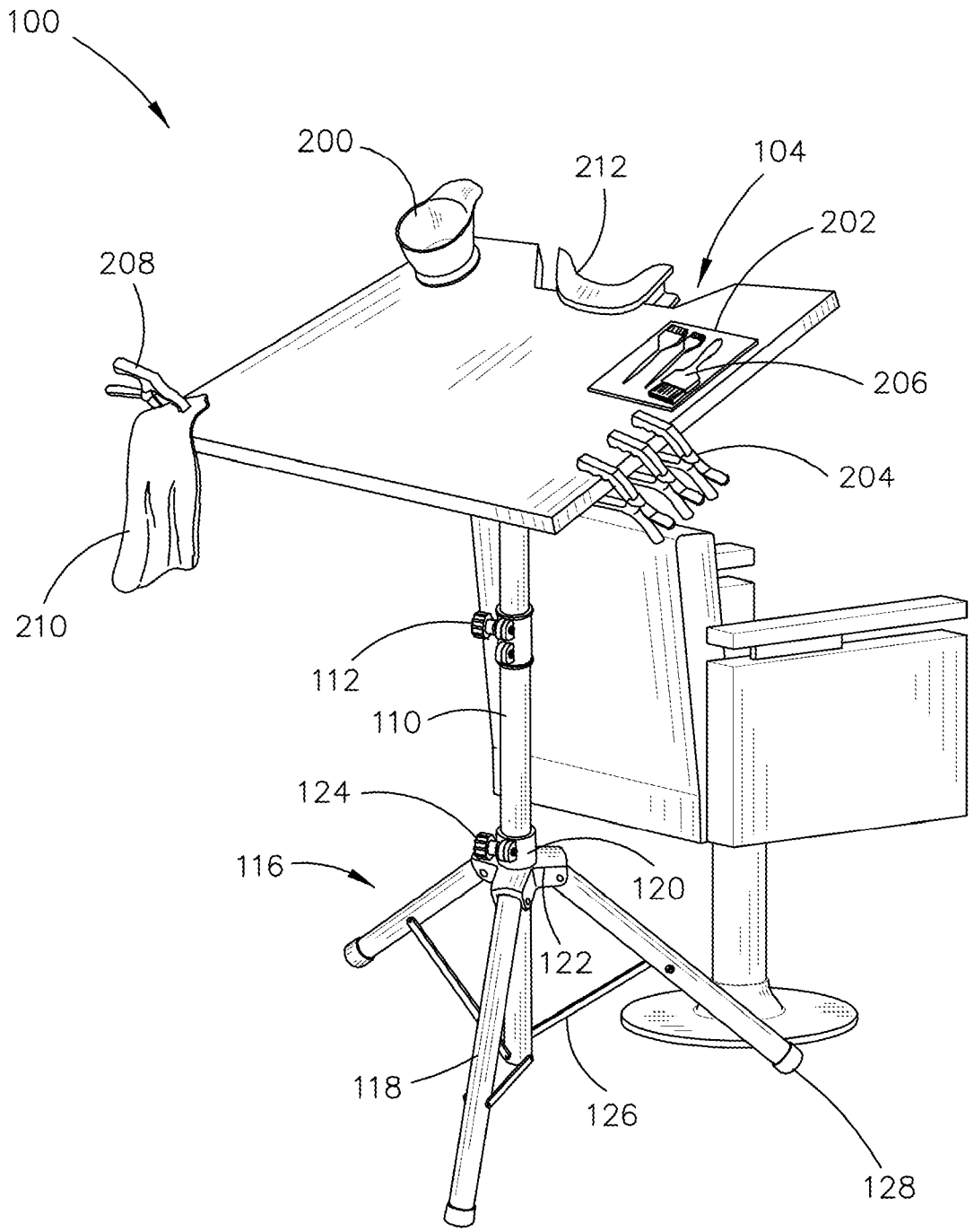
FIG. 2 illustrates a perspective view of a mobile color and style application device including one or more hair stylist tools, in accordance with one or more embodiments of the present disclosure.

FIG. 2 illustrates a perspective of the device 100 including one or more hair stylist tools, in accordance with one or more embodiments of the present disclosure.

In embodiments, a surface of the one or more platforms 102 is configured to couple to one or more hair stylist tools. For example, the outer surface of the one or more platforms 102 may be formed of a non-slip material such that the outer surface of the one or more platforms 102 may be configured to couple to the one or more hair stylist tools. For instance, the outer surface of the one or more platforms 102 may be configured to couple to one or more bowls 200 (e.g., suction bowls, silicone bowls, magnetic bowls, or the like). In this regard, the one or more bowls 200 may include one or more suction cup fasteners. In another instance, the outer surface of the one or more platforms 102 may be configured to couple to one or more heat resistant mats 202 (e.g., a silicone heat resistant mat). In this regard, the one or more heat resistant mats 202 may include one or more suction mat fasteners. In a further instance, the outer surface of the one or more platforms 102 may be configured to couple to one or more color application brushes 206 (e.g., a silicone handle color application brush). In this regard, the one or more brushes 206 may include one or more suction ends.

By way of another example, although not shown, the one or more platforms 102 may couple to a mannequin head to allow for practice. For example, the mannequin head may couple to the one or more platforms 102 via one or more fasteners including, but not limited to, one or more screws, one or more bolts, one or more adhesives, one or more clips (or clamps), or the like.

By way of another example, the one or more platforms 102 may be configured to couple to one or more towels 210. For instance, the one or more platforms 102 may be configured to couple to the one or more towels 210 via one or more towel clips 208. In this regard, an edge of the one or more platforms 102 may be configured to allow a stylist to attach the one or more towel clips 208 to the edge of the one or more platforms 102. In another instance, the one or more platforms 102 may include one or more holes such that a stylist may attach (e.g., clip, thread, or the like) the one or more towels 210 to the one or more platforms 102.

By way of a further example, the one or more platforms 102 may be configured to couple to one or more hair clips 204 (e.g., hair sectioning clips). For instance, an edge of the one or more platforms 102 may be configured to allow a stylist to clamp (or clip) the one or more hair clips 204 to the edge of the one or more platforms 102.

By way of a further example, the one or more platforms 102 may be configured to couple to foil. For instance, the one or more platforms 102 may include a fastening system to allow for the easy use of foil (or another surface layer which may be employed in a color application). In this regard, a foil clip or any other fastener may secure the foil to the platform, It is noted herein that the use of foil may provide higher levels of lift and improve the durability and cleanup of the mobile color and style application device. Further, it is noted herein that custom-made sheets of foil, which match the size, dimension, and orientation of the platform (or riser) may be placed on the platform (or riser).

It is noted herein that the customized foil sheets may provide a solution to the traditional balayage method. The customized foil sheets may improve the color process. The traditional method of balayage provides only mild results. Balayage alone cannot support aggressive; lighter levels of lift when highlighting hair, which is what is needed when coloring hair. Consumers want the subtle soft movement of hair color that comes from the method, but lack the variety of options that come from basic highlighting with foil. It is noted herein that the mobile color and style application device, with foil, may provide a creative color that is placed with precision and lifts. The mobile color and style device may allow the art of freehand hair painting to be implemented all while honoring the chemistry of hair color, and supporting higher levels of hit.

In some embodiments, the device 100 may further include one or more heating elements. For example, the device 100 may include one or more heating elements configured to be laid on each platform individually. By way of another example, the device 100 may include one or more heating elements configured to enclose all of the platforms after the painting of the hair is completed to heat the hair and give it extra "Lift". The one or more heating elements may include one or more heat lamps, one or more heat pads, one or more hair dryers, one or more induction plates, or the like configured to be laid on each platform or enclose the one or more platforms.

In embodiments, the one or more platforms 102 include one or more cut-outs 104. The one or more cut-outs 104 may be configured to conform to a portion of at least one of a head or a neck of a user. For example, the one or more cut-outs 104 may be configured to conform to a curve of the neck or a curve of the head of a user. For instance, the one or more cut-outs 104 may be trapezoidal (or substantially trapezoidal). In another instance, the one or more cut-outs 104 may be semi-circular (or substantially semi-circular). In a further instance, the one or more cut-outs 104 may be rectangular (or substantially rectangular). However, it is noted herein that the one or more cut-outs 104 may be any shape known in the art suitable for conforming to the neck or the head of a user, therefore the above discussion should not be a limitation on the scope of the present disclosure.

As shown in FIG. 2, a neck rest 212 may be configured to couple to a portion of the one or more platforms 102. For example, the neck rest 212 may be configured to couple to the one or more cut-outs 104 of the one or more platforms 102. For instance, a shape of the one or more cut-outs 104 may complement the shape of the neck rest 212, such that a receiving end of the neck rest 212 may couple to the one or more cut-outs 104. The neck rest 212 may be configured to couple to the one or more platforms 102 via any coupling mechanism known in the art including, but not limited to, tension fit, one or more magnets, one or more hook and look fasteners, or the like.

Figure 3:
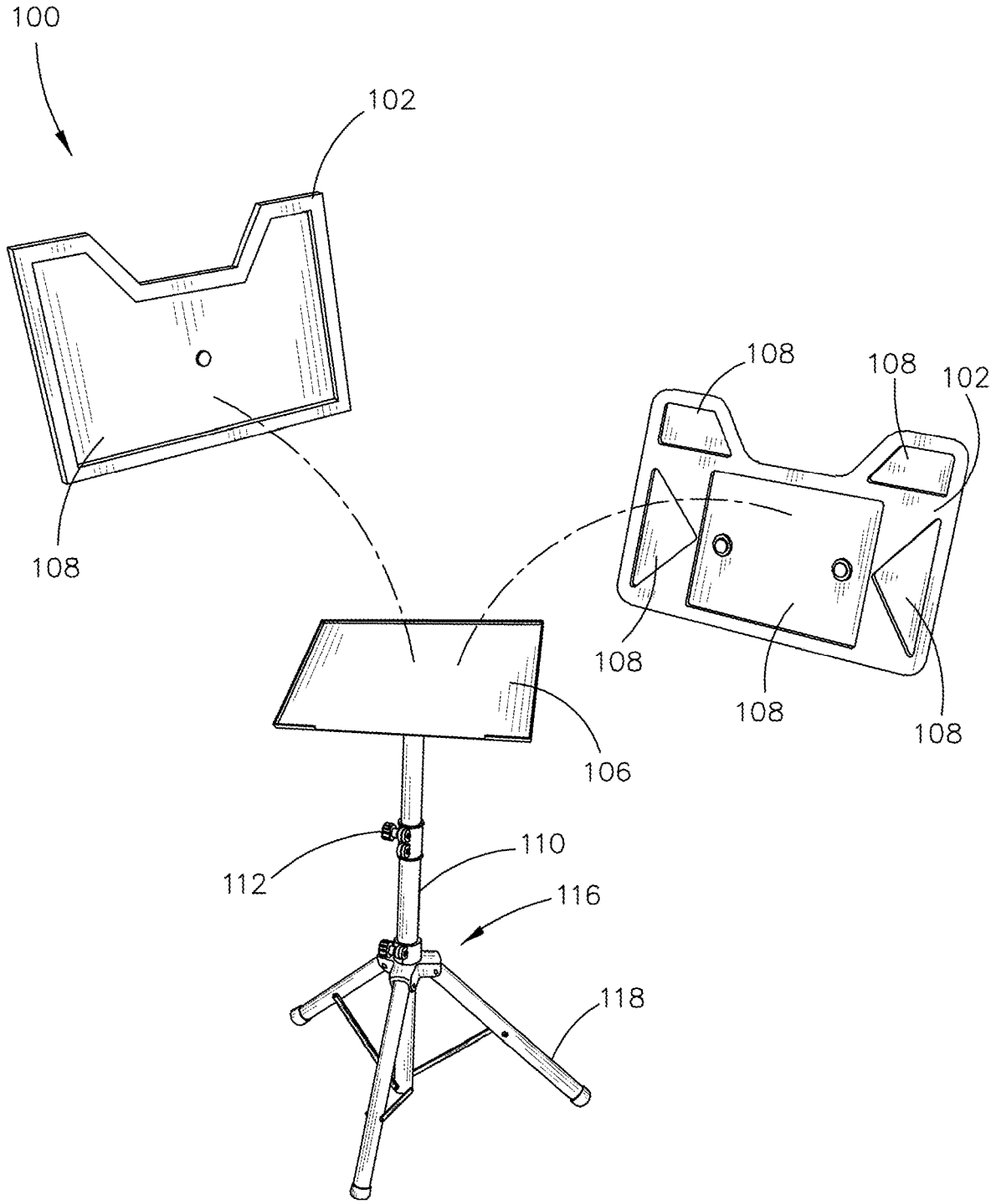
FIG. 3 illustrates a perspective view of a mobile color and style application device, in accordance with one or more embodiments of the present disclosure.
Figure 4:
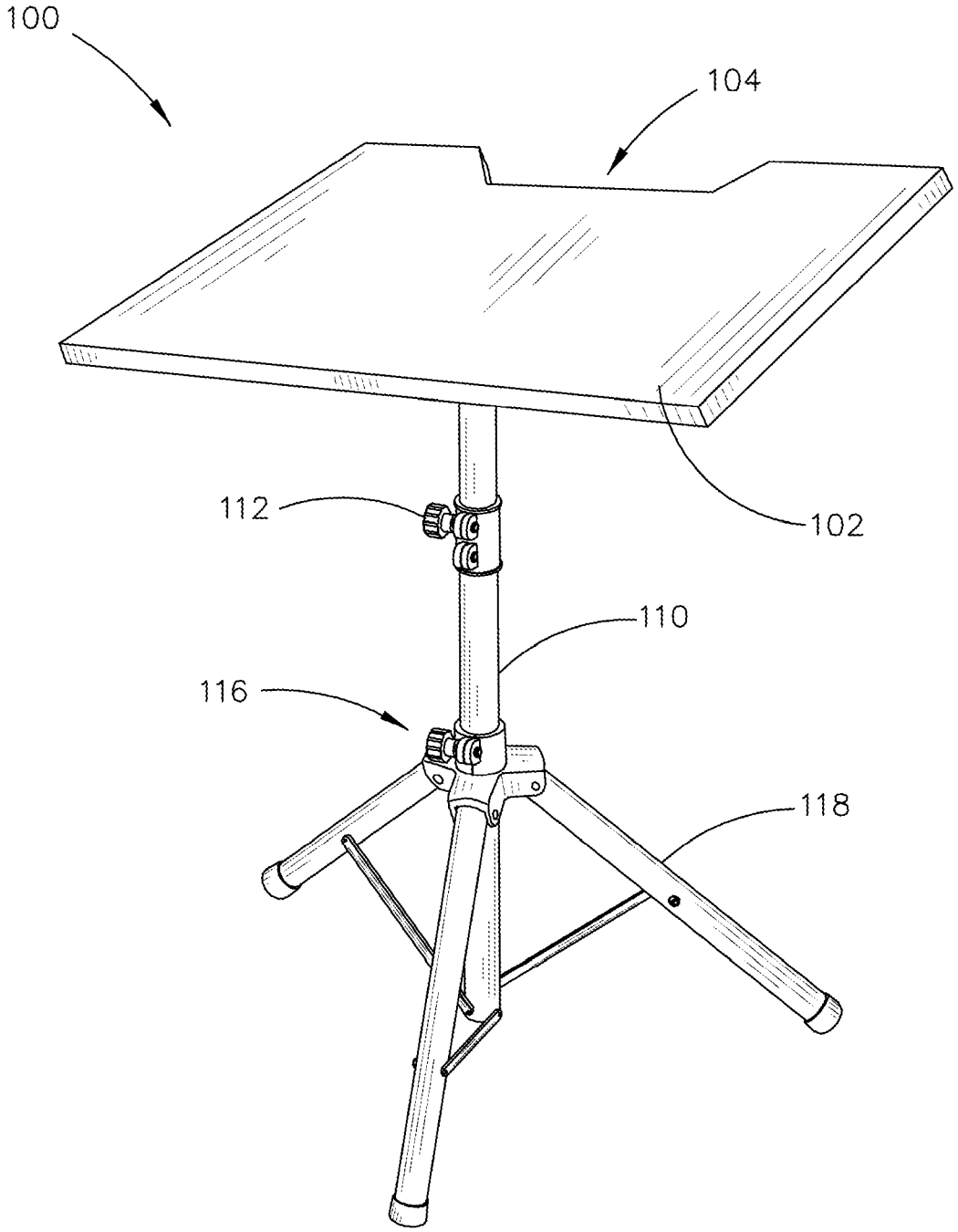
FIG. 4 illustrates a perspective view of a mobile color and style application device, in accordance with one or more embodiments of the present disclosure.
Figure 5:
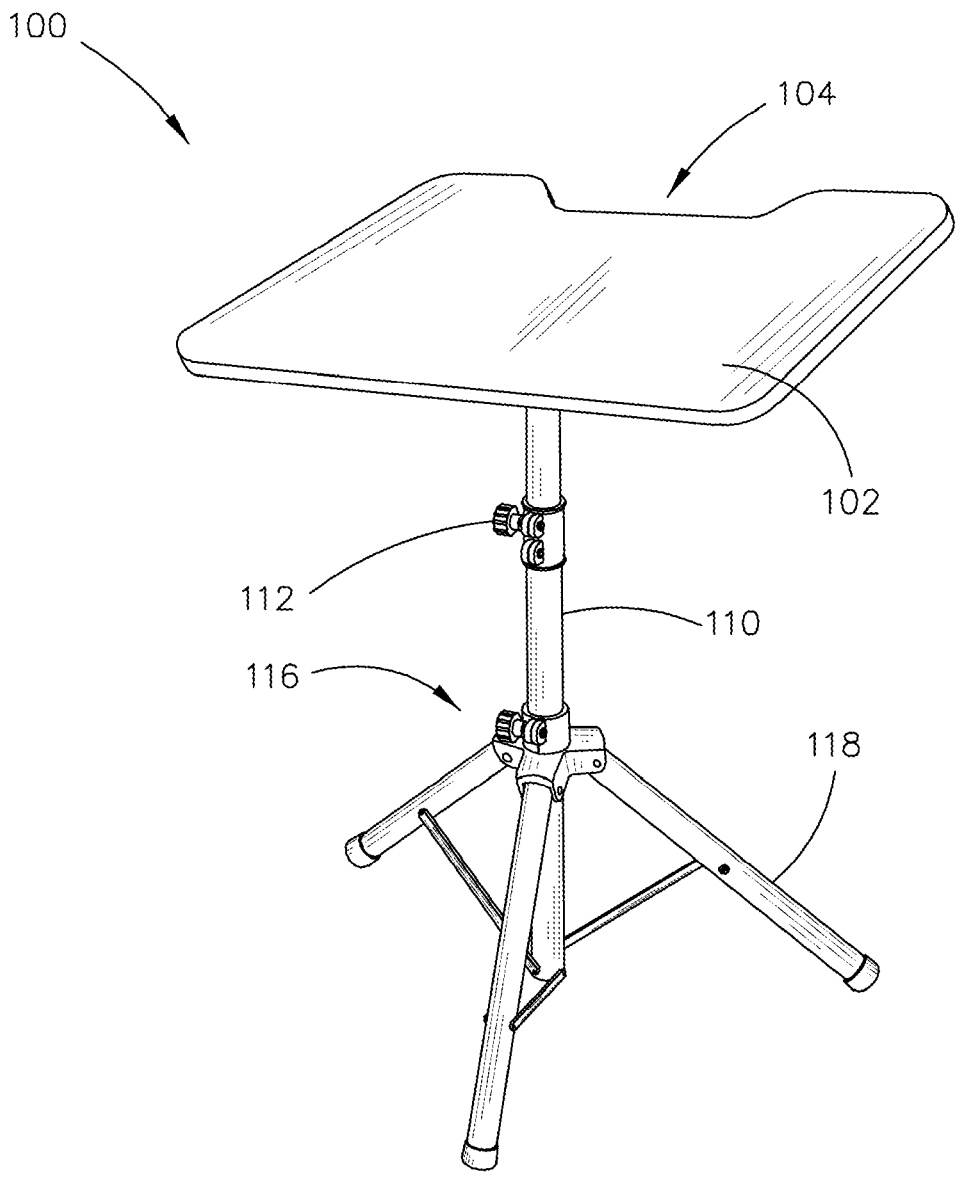
FIG. 5 illustrates a perspective view of a mobile color and style application device, in accordance with one or more embodiments of the present disclosure.

FIGS. 3-5 illustrate perspective views of the device 100, in accordance with one or more embodiments of the present disclosure.

In embodiments, the device 100 includes one or more plates 106 configured to couple to the one or more platforms 102. For example, the one or more platforms 102 may be couplable to a portion of the one or more plates 106 via a quick-connect coupling mechanism. It is noted herein that the quick-connect coupling mechanism may include any quick-connect coupling mechanism known in the art.

For example, as shown in FIG. 3, the one or more platforms 102 may be couplable to the one or more plates 106 via one or more magnetic connections. For instance, the one or more platforms 102 may include a south-seeking pole magnet and the one or more plates 106 may include a north-seeking pole magnet, or vice versa. In this regard, the north-seeking pole magnet may attract the south-pole magnet such that the one or more platforms 102 may couple to the one or more plates 106.

By way of another example, the one or more platforms 102 may be couplable to the one or more plates 106 via a hook and loop mechanism. For instance, the one or more platforms 102 may include a hook mechanism and the one or more plates 106 may include a loop mechanism, or vice versa. In this regard, the loop mechanism may attract the hook mechanism such that the one or more platforms 102 may couple to the one or more plates 106.

By way of a further example, the one or more platforms 102 may be couplable to the one or more plates 106 via an interlocking assembly. For instance, the interlocking assembly may include a tab-and-groove assembly such that the one or more plates 106 include one or more grooves and the one or more platforms 102 include the respective one or tabs, or vice versa. In a further instance, the interlocking assembly may include a tab-and-groove assembly such that the one or more plates 106 include one or more slots and the one or more platforms 102 include the respective one or tabs, or vice versa.

By way of a further example, the one or more platforms 102 may be couplable to the one or more plates 106 via push button mechanism. For instance, the one or more platforms 102 may include one or more push buttons and the one or more plates 106 may include one or more receiving ends, such that the one or more push buttons may be coupled to the one or more receiving ends, or vice versa. In this regard, a user may release the one or more push buttons by compressing the one or more push buttons coupled to the one or more receiving ends.

By way of a further example, the one or more platforms 102 may be couplable to the one or more plates 106 via a spring-loaded button mechanism. For instance, the one or more platforms 102 may include one or more tabs and the one or more plates 106 may include one or more receiving ends and one or more spring-loaded buttons, such that a user may compress the spring-loaded button on the one or more plates 106 disengaging the one or more tabs from the one or more receiving ends.

By way of a further example, the one or more platforms 102 may be couplable to the one or more plates 106 via a spring tab mechanism. For instance, the one or more platforms 102 may include one or more tabs and the one or more plates 106 may include one or more receiving ends and one or more spring-loaded buttons, such that a user may compress the spring tab mechanism on the one or more plates 106 disengaging the one or more tabs from the one or more receiving ends.

In some embodiments, an underside of the platform 102 may include a quick-connect coupling mechanism to connect to a top-side of the plate 106. For example, an underside of the platform 102 may include a south-seeking pole magnet and a top-side of the plate 106 may include a north-seeking pole magnet, or vice versa. By way of another example, an underside of the platform 102 may include a hook mechanism and a top-side of the platform 102 may include a loop mechanism, or vice versa. It is noted herein the underside of the platform 102 and/or the top-side of the plate 106 may include any quick-connect coupling mechanism known the art including, but not limited to, a magnetic connection, a hook and loop connection, a tension fit connection, a push button mechanism, or the like.

For purposes of the present disclosure, the term "quick-connect" means a connection that may be easily and quickly affixed and/or detached. For example, the quick-connect mechanism of the one or more platforms 102 and/or the one or more plates 106 may allow the one or more platforms 102 and/or the one or more plates 106 to be quickly and easily affixed and/or detached to the one or more plates 106 and/or the one or more platforms 102, respectively.

It is noted herein that the quick-connect mechanism used to couple the one or more platforms 102 to the one or more plates 106 may be configured to allow the one or more platforms 102 to be easily attached to a wall of a salon. For example, the one or more platforms 102, including the one or more graphical representations, may be attached to the wall of the salon, such that the one or more platforms 102 may act as a piece of artwork on the wall of the salon. Further, it is noted herein that the one or more platforms 102 may further include one or more mounting brackets and/or one or more wires to aid a user to hang the one or more platforms on a wall.

In some embodiments, as shown in FIG. 3, a bottom surface of the one or more platforms 102 may include one or more bottom recessed areas 108. In this embodiment, the one or more bottom recessed areas 108 are configured to decrease the weight of the one or more platforms 102 (e.g., form a light-weight platform). The one or more bottom recessed areas 108 may be any shape and/or thickness suitable for providing a durable platform. For example, the one or more bottom recessed areas 108 may be triangular. By way of another example, the one or more bottom recessed areas 108 may be rectangular. By way of a further example, the one or more recessed areas 108 may be trapezoidal. Further, the one or more bottom recessed areas 108 and the one or more plates 106 may have complementary shapes such that a shape of a bottom recessed area may complement a shape of a plate.

Figure 6:
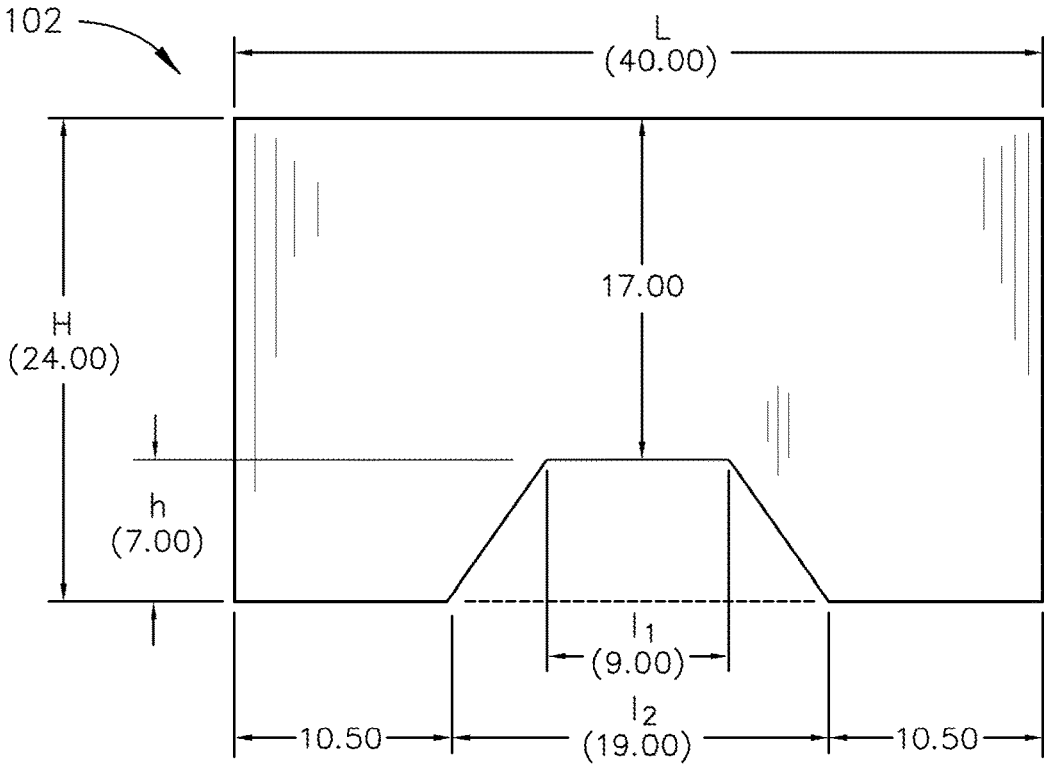
FIG. 6 illustrates a simplified top down view of a platform of a mobile color and style application device, in accordance with one or more embodiments of the present disclosure.
Figure 13:
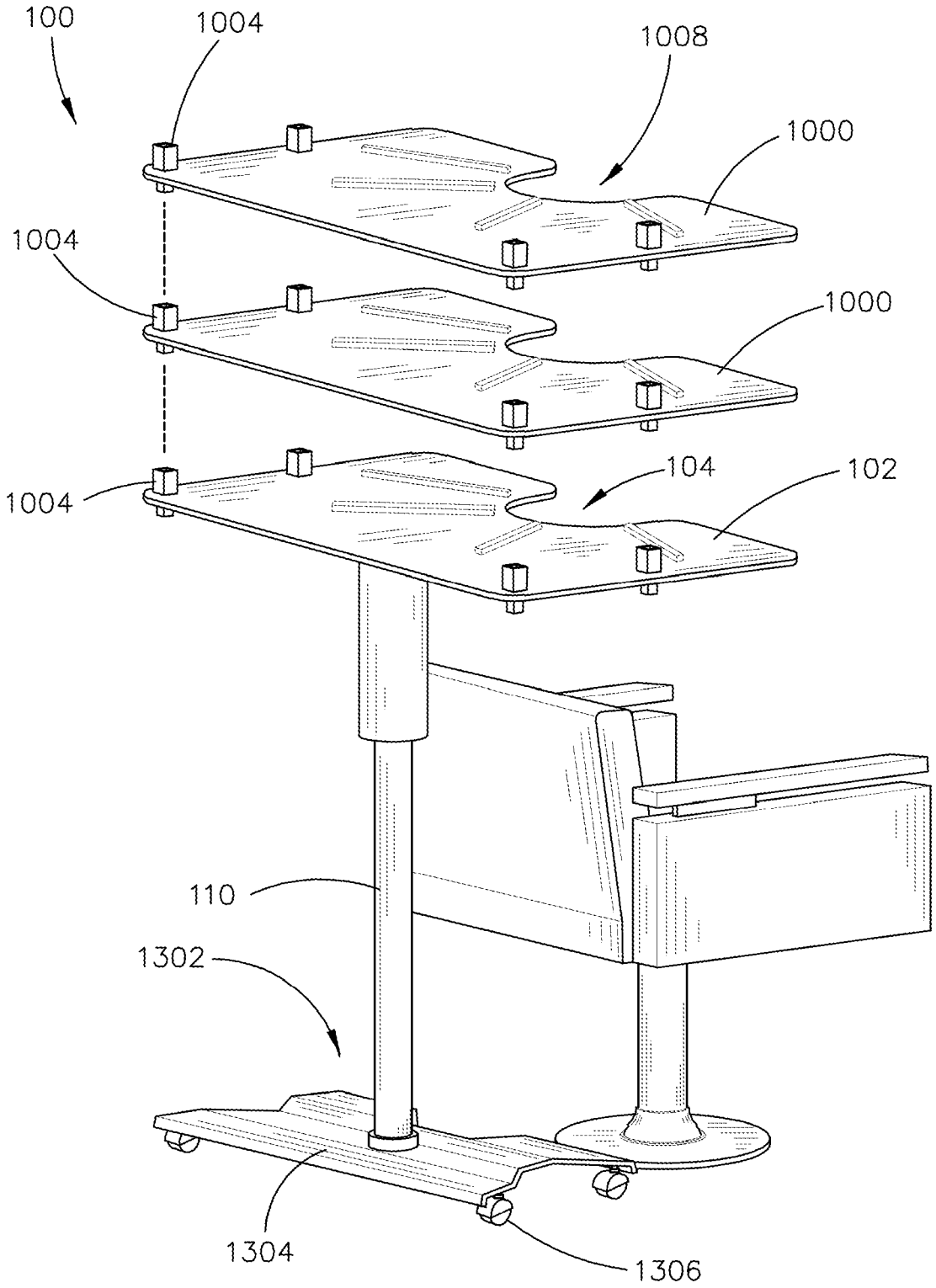
FIG. 13 illustrates a perspective view of a mobile color and style application device, in accordance with one or more embodiments of the present disclosure.
Figure 14:
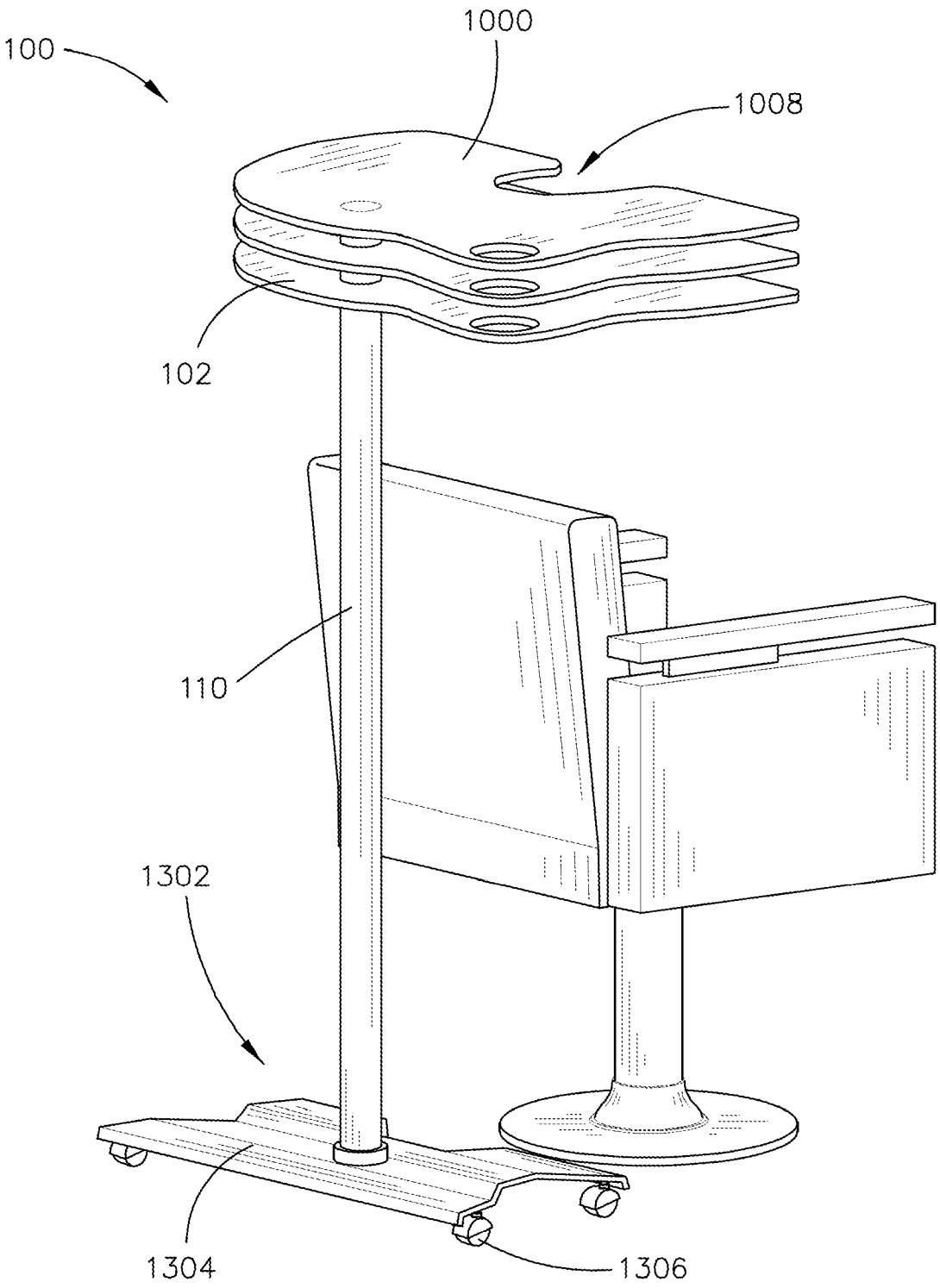
FIG. 14 illustrates a perspective view of a mobile color and style application device, in accordance with one or more embodiments of the present disclosure.

Referring to FIGS. 3 and 6, the one or more plates 104 may be configured to couple a variety of platforms for a variety of clients (e.g., variety of hair types). The one or more platforms 102 may be any shape known in the art suitable for color application. For example, as shown in FIGS. 1-13, the one or more platforms 102 may be substantially rectangular. For instance, as shown in FIG. 4, the one or more platforms 102 may be rectangular with non-curved corners (straight corners). In a further instance, as shown in FIG. 5, the one or more platforms 102 may be rectangular with curved corners. By way of another example, as shown in FIG. 14, the one or more platforms 102 may be semi-circular.

The one or more platforms 102 may be any dimension suitable for color application. For example, as shown in FIG. 6, the one or more platforms 102 may be 40.00"×24.00" (e.g., have a length L of 40.00 inches and a height H of 24.00 inches). It is noted herein that the shape and dimensions of the one or more platforms 102 may be adjusted to apply a particular service to a particular client. For example, a larger platform may be used with a client with longer hair and a shorter platform may be used with a client with shorter hair.

The one or more cut-outs 104 may further be any shape and/or dimension suitable for conforming to a portion of a neck or a head of a user. For example, as shown in FIG. 6, the one or more cut-outs 104 may be trapezoidal with a first length $l_1$ of 9.00 inches, a second length $l_2$ of 19.00 inches, and a height h of 7.00 inches.

Further it is noted herein that the one or more platforms 102 and/or the one or more cut-outs 104 may be cut and/or formed using any fabrication process known in the art including, but not limited to, laser cutting, injection molding, hand cutting, or the like.

Figure 8:
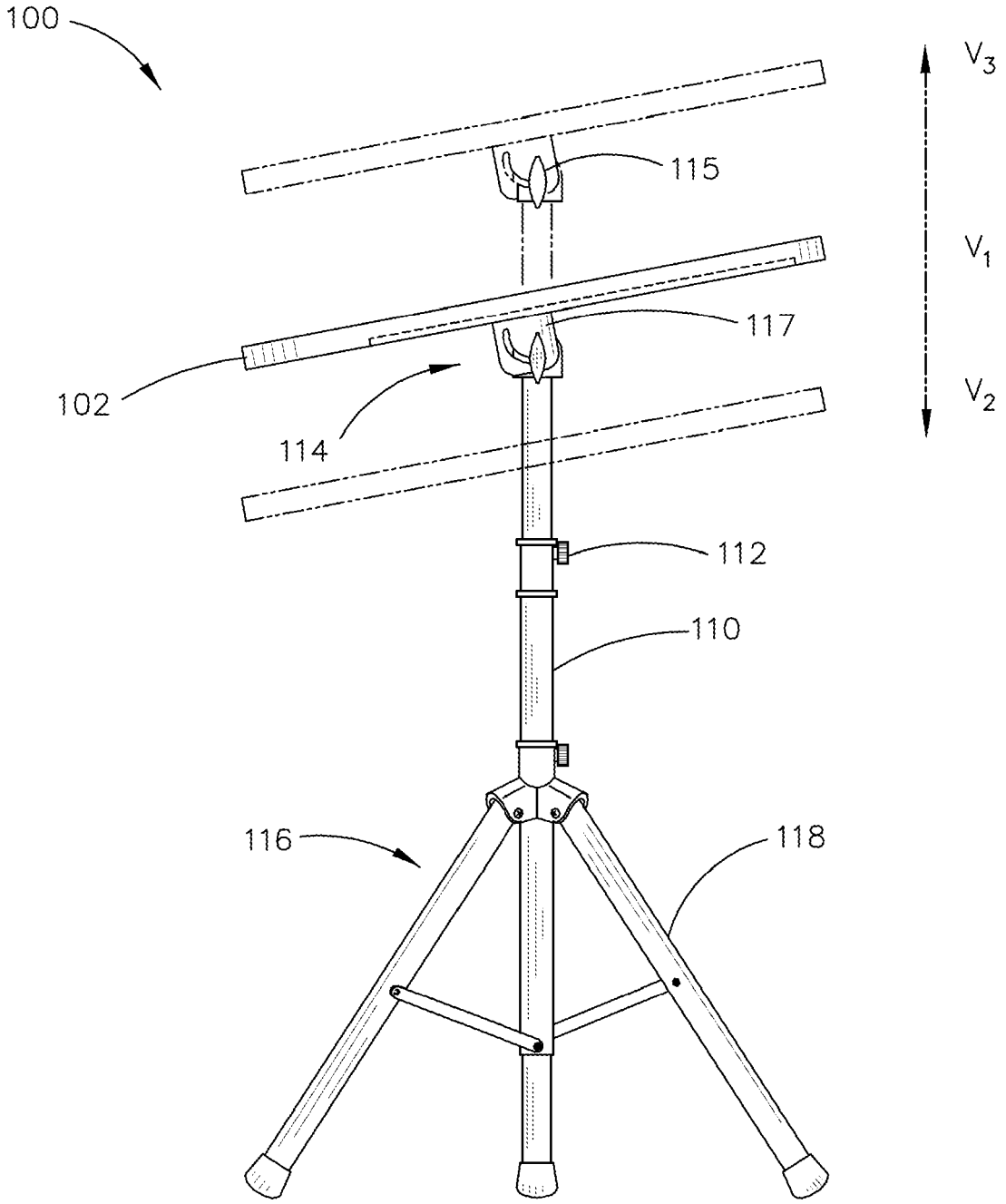
FIG. 8 illustrates a side view of a mobile color and style application device, in accordance with one or more embodiments of the present disclosure.
Figure 9:
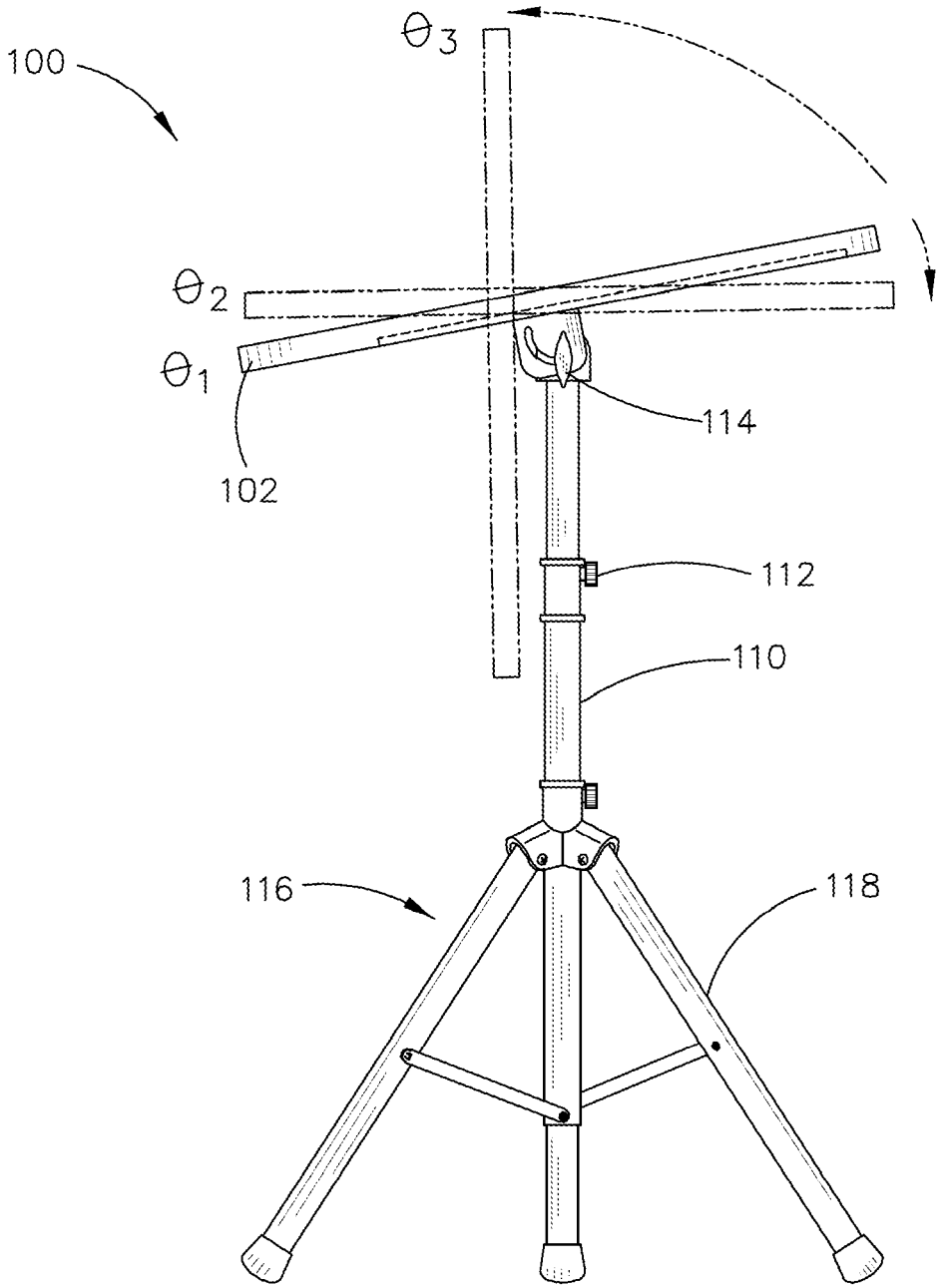
FIG. 9 illustrates a side view of a mobile color and style application device, in accordance with one or more embodiments of the present disclosure.

FIGS. 8-9 illustrate side views of the device 100, in accordance with one or more embodiments of the present disclosure.

In embodiments, the device 100 includes an adjustable tower 110. For example, the adjustable tower 110 may be couplable to a portion of the one or more plates 106. For instance, the one or more plates 106 may be coupled to a bracket such that the one or more fasteners may couple the bracket to the adjustable tower 110. Further, the one or more plates 106 may be coupled to a u-bracket such that a set screw may couple the adjustable tower 110 to the u-bracket. In another instance, as shown in FIG. 13, the one or more plates 106 may couple to a sleeve such that the sleeve is configured to couple to the adjustable tower 110.

In some embodiments, the one or more platforms 102 are configured to couple directly to the adjustable tower 110. For example, the one or more platforms 102 may be coupled to the adjustable tower 110 via one or more quick-connect coupling mechanisms. For instance, the adjustable tower 110 may include a clamp configured to couple the one or more platforms to the adjustable tower. In this regard, upon release of the clamp, the platform 102 may be removed from the adjustable tower. In another instance, the adjustable tower 110 may include a quick-release pin configured to couple the one or more platforms 102 to the adjustable tower 110. It is noted herein that the quick-connect coupling mechanism may include any mechanism known in the art including, but not limited to, a clamp connection, a quick-release pin connection, magnetic connection, a spring-loaded button mechanism, or the like.

In embodiments, the adjustable tower 110 includes one or more tower locks 112 configured to adjust a vertical height of the adjustable tower 110. For example, as shown in FIG. 8, the adjustable tower 110 may include one or more knob tower locks 112. For instance, the one or more knob tower locks 112 may be configured to adjust the vertical height of the adjustable tower 110 (e.g., $V_1$, $V_2$, $V_3$ . . . $V_n$) upon un-screwing or tightening the knob of the one or more knob tower locks 112. In this regard, the adjustable tower 110 may be configured to adjust from a first height $V_1$ to a second height $V_2$. Further, the adjustable tower may be configured to adjust from a first height $V_1$ to a third height $V_3$. Further, the adjustable tower 110 may be configured to adjust from a second height $V_2$ to a third height $V_3$. It is noted herein that the vertical height of the adjustable tower 110 may be adjusted to a variety of heights $V_n$ for optimal use with any client or stylist, such that they are positioned comfortably for each individual client and stylist. Further, it is noted herein that the one or more tower locks 112 may include any locking mechanism known in the art including, but not limited to, clamps, knobs (with threaded fasteners), levers, or the like. In this regard, the vertical height of the adjustable tower 110 may be adjusted such that the one or more cut-outs 104 conform to the user's head or neck.

In embodiments, the one or more plates 104 include one or more plate locks 114 configured to adjust a tilt angle (e.g., $\theta_1$, $\theta_2$, $\theta_3$ . . . , $\theta_n$) of the one or more plates 106. For example, the one or more plates 104 may be configured to adjust from a first angle $\theta_1$ to a second angle $\theta_2$. By way of another example, the one or more plates may be configured to adjust from a second angle $\theta_2$ to a third angle $\theta_3$. By way of another example, the one or more plates may be configured to adjust from a first angle $\theta_1$ to a third angle $\theta_3$. The tilt angle $\theta_n$ of the one or more plates 106 may be between 0-180 degrees. For example, the tilt angle of the one or more plates 106 may be between 30-60 degrees. For instance, the tilt angle of the one or more plates 106 may be 45 degrees.

The one or more plate locks 114 may be configured to adjust a tilt angle of the one or more plates 106 via any mechanism known in the art. For example, as shown in FIG. 9, the one or more plates locks 114 may include one or more knobs 115 configured to adjust the tilt angle of the one or more plates 106. For instance, the one or more knobs 115 of the one or more plate locks 114 may be configured to couple to one or more fasteners 117 including one degree of freedom (DOF) via one or more shanks (e.g., threaded or non-threaded) of the one or more knobs 115, such that upon un-screwing/tightening the one or more knobs, the one or more shanks may disengage/engage with a groove of the one or more fasteners 117 (e.g., the bracket 117). In this regard, upon un-screwing the one or more knobs 115, the one or more shanks may be allowed to adjust by one degree of freedom within the groove of the one or more fasteners 117.

Although FIG. 9 illustrates a specific plate lock configuration, the one or more plate locks 114 may employ any locking mechanism known in the art, including, but not limited to, one or more levers, one or more knobs, one or more pivot mechanisms, one or more ball and socket joints, or the like.

In embodiments, the device 100 includes a base 116 configured to provide stability and support. For example, the adjustable tower 110 may be coupled to the base 116.

In some embodiments, the base 116 includes one or more legs 118. For example, the base 116 may be a tripod base including three legs (e.g., tripod legs). For instance, as shown in FIG. 1, the tripod base including the three legs 118 may be arranged such that the tripod legs 118 fit behind all salon chairs. However, it is noted herein that the base 116 may include any number of legs suitable for providing stability and support. For example, the base 116 may include two legs, four legs, up to an N number of legs such that the legs provide stability and support.

In this embodiment, the base 116 may include one or more couplers 120. For example, the base 116 may include one or more couplers 120 including one or more leg joints 122. The one or more leg joints 122 of the one or more couplers 120 may be configured to receive a portion of the one or more legs 118. It is noted herein that the one or more couplers 120 including the one or more leg joints 122 may be coupled to the one or more legs 118 via any fastening mechanism known in the art including, but not limited to, one or more screws, one or more bolts, tension fit, welding, adhesives, or the like.

The one or more legs 118 may be coupled to the base 116 via one or more leg braces 126. For example, an inner surface of the one or more couplers 120 may define a cavity configured to receive a portion of the adjustable tower 110 such that the adjustable tower 110 may protrude through the one or more couplers 120 and couple to the one or more leg braces 126.

Although FIGS. 1-5 depict the device 100 including one or more couplers 120, it is noted herein that the adjustable tower 110 may be coupled directly to the base 116. For example, the adjustable tower 110 may be coupled directly to the base 116 via any fastening mechanism known in the art, including, but not limited to, one or more screws, one or more bolts, one or more pins, or the like.

In embodiments, the base 116 may further include one or more leg locks 124 configured to adjust the one or more legs 118. For example, the one or more leg locks 124 may be configured to adjust a height of the one or more legs 118. By way of another example, the one or more leg locks 124 may be configured to adjust a distance of separation between a proximate leg of the one or more legs 118. In this regard, the width of the leg stance may be adjusted (e.g., to make the base wider or narrower), such that the one or more legs 118 may fit behind any salon chair.

The one or more leg locks 124 may include any locking mechanism known in the art including, but not limited to, a knob, a lever, a clamp, quick-release pin, or the like. For example, the one or more leg locks 124 may include one or more knobs such that a user may tighten and/or un-screw the one or more knobs upon adjustment of the one or more legs 118.

In some embodiments, the base 116 includes one or more telescoping legs (not shown). In this embodiment, the base 116 may include one or more leg locks configured to adjust a height of the one or more telescoping legs. For example, the one or more telescoping legs may include one or more knobs configured to adjust a height of the one or more telescoping legs. For instance, the one or more knobs may be un-locked when changed in the height and may be locked when a sufficient height has been reach. By way of another example, the one or more telescoping legs may include one or more push-button mechanisms configured to adjust a height of the one or more telescoping legs. For instance, the one or more telescoping legs may include a plurality of push-button mechanisms along the height of the one or more telescoping legs, such that the plurality of push-button mechanisms allow the height of the one or more telescoping legs to be varied based on the height of the plurality of push-button mechanisms. By way of further example, the one or more telescoping legs may include one or more twist portions configured to adjust a height of the one or more telescoping legs. For instance, the one or more twist portions may allow an inner tube of the one or more telescoping legs to disengage from an outer tube of the one or more telescoping legs, such that the height of the one or more telescoping legs may be adjusted.

In some embodiments, the one or more legs 118 and/or the one or more telescoping legs may include one or more feet 128. The one or more feet 128 may be configured to prevent the device 100 from sliding on the salon floor. For example, the one or more feet 128 may be formed of a non-slip material such as, but not limited to, rubber, silicone, or the like.

Figure 11:
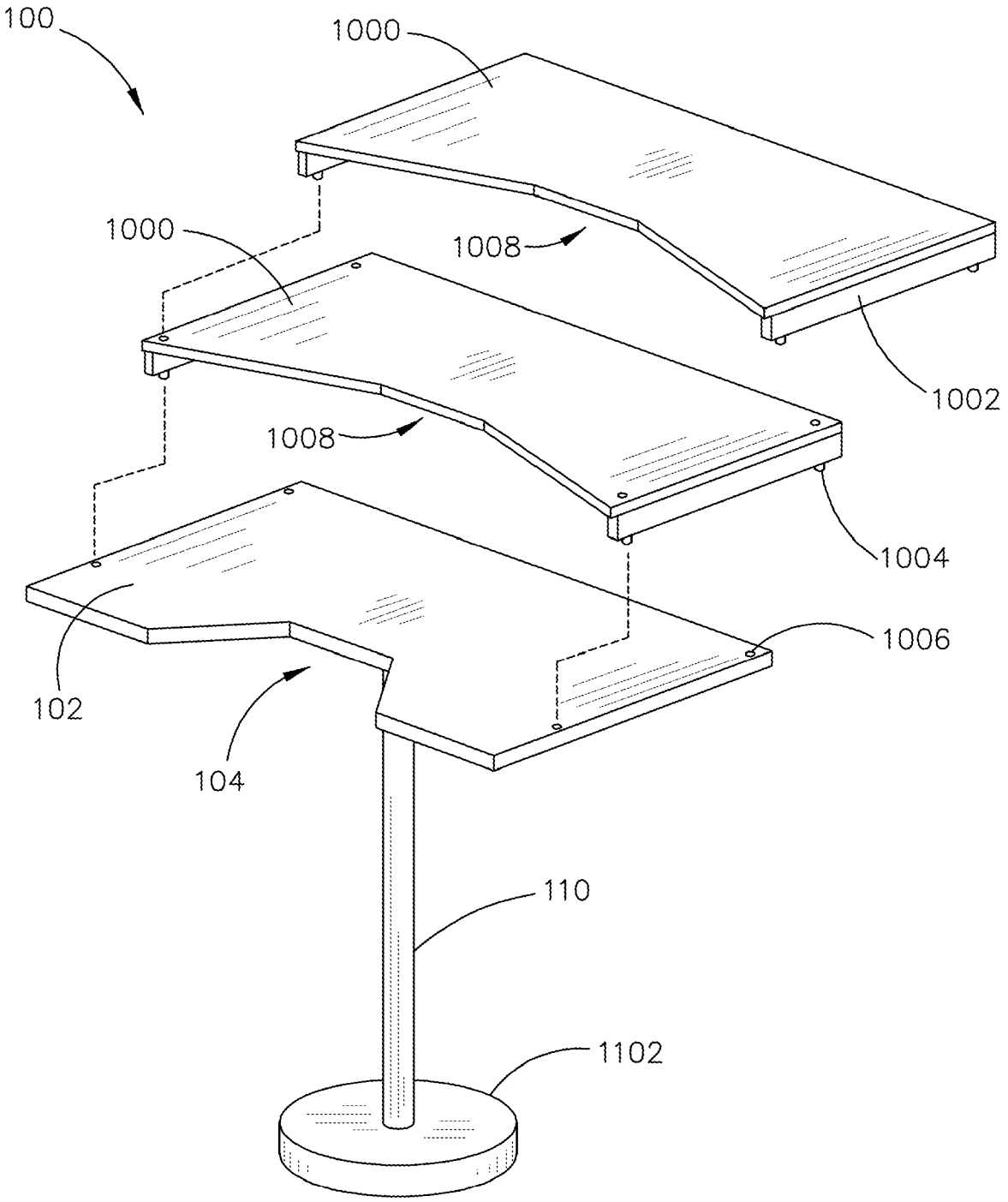
FIG. 11 illustrates a perspective view of a mobile color and style application device, in accordance with one or more embodiments of the present disclosure.
Figure 12:
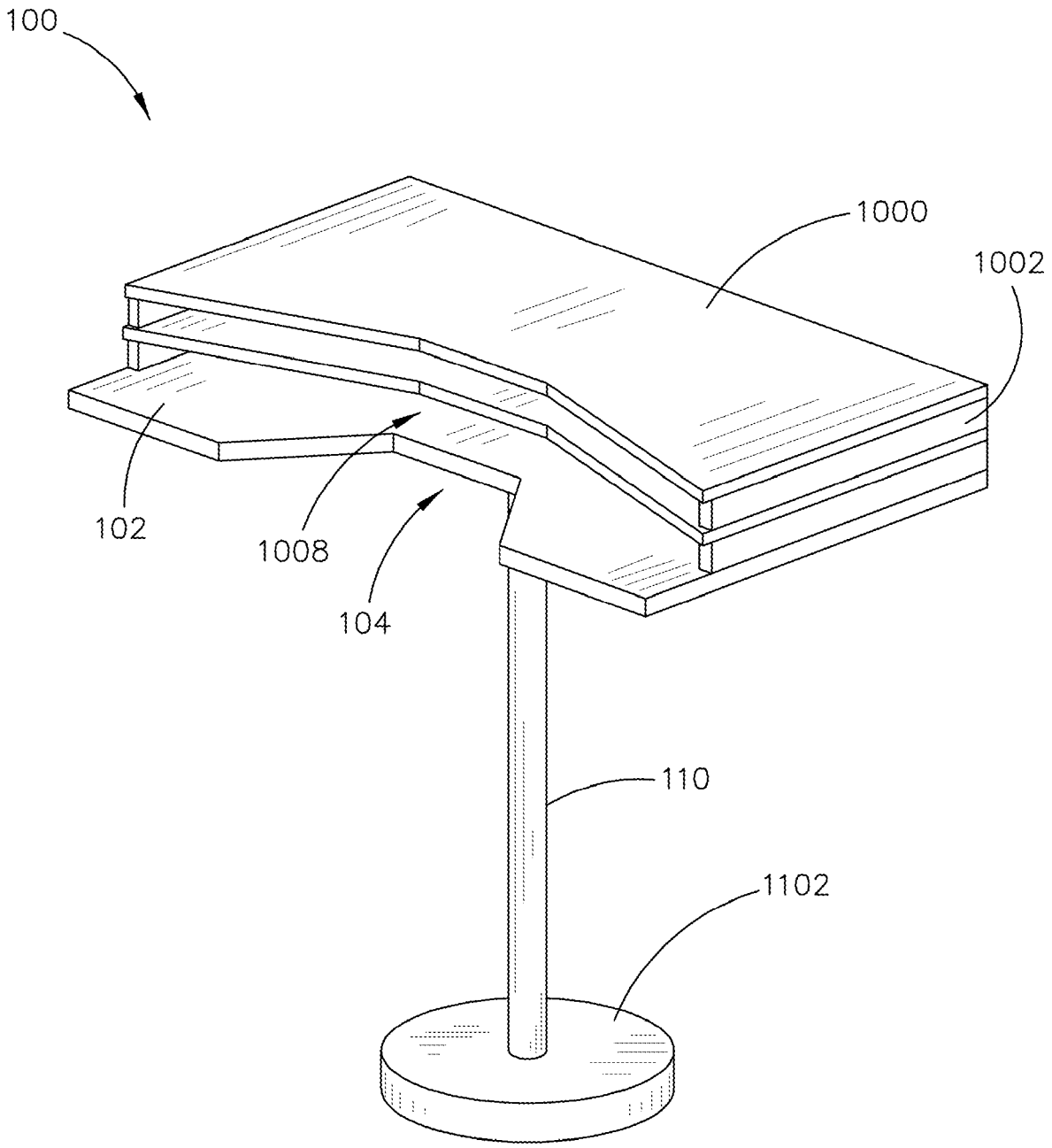
FIG. 12 illustrates a perspective view of a mobile color and style application device, in accordance with one or more embodiments of the present disclosure.

Referring to FIGS. 11-12, in some embodiments, a device 1100 includes a base 1102 configured to provide support and stability. For example, the base 1102 may include a stand 1102. For instance, the stand 1102 may be formed of a sturdy material configured to provide support and stability. The stand 1102 may be hollow such that the stand 1102 may be filled with sand, water, or the like to provide support and stability. Further, the stand 1102 may be non-hollow.

Although FIGS. 11-12 depict the base 1102 as circular, it is noted herein that the base 1102 may be any shape known in the art. For example, the base 1102 may be rectangular. By way of another example, the base 1102 may be trapezoidal. By way of a further example, the base 1102 may be semi-circular.

Referring to FIGS. 13-14, in some embodiments, a device 100 includes a base 1302 configured to provide support and stability. The base 1302 may include one or more stands 1304. The one or more stands 1304 may include one or more wheels 1306. The one or more wheels 1306 may include one or more lockable wheels configured to secure the device 100 in a fixed position. Although FIGS. 13-14 show the base 1302 including four wheels 1306, the base 1302 may include any number of wheels suitable for providing support and stability.

The one or more stands 1304 may be any shape and/or size known in the art. For example, the one or more stands 1304 may include one or more stand cut-outs 1308 configured to conform to a portion of a salon chair. For instance, the one or more stand-cut outs 1308 may be semi-circular, trapezoidal, rectangular, or the like.

Although FIGS. 13-14 depict the one or more stands 1304 including a rigid surface, it is noted herein that the one or more stands 1304 may have a smooth or non-smooth (e.g., rigid surface).

The base 1302 and/or the one or more stands 1304 may couple to the one or more wheels 1306 via any mechanism known in the art.

Referring to FIG. 13, in some embodiments, the one or more platforms 102 may include one or more ridges 1310 configured to assist in the spreading of a client's hair. In some embodiments, the one or more platforms 102 may include one or more recessed areas (not shown) configured to contain and hold a section of hair.

Figure 10:
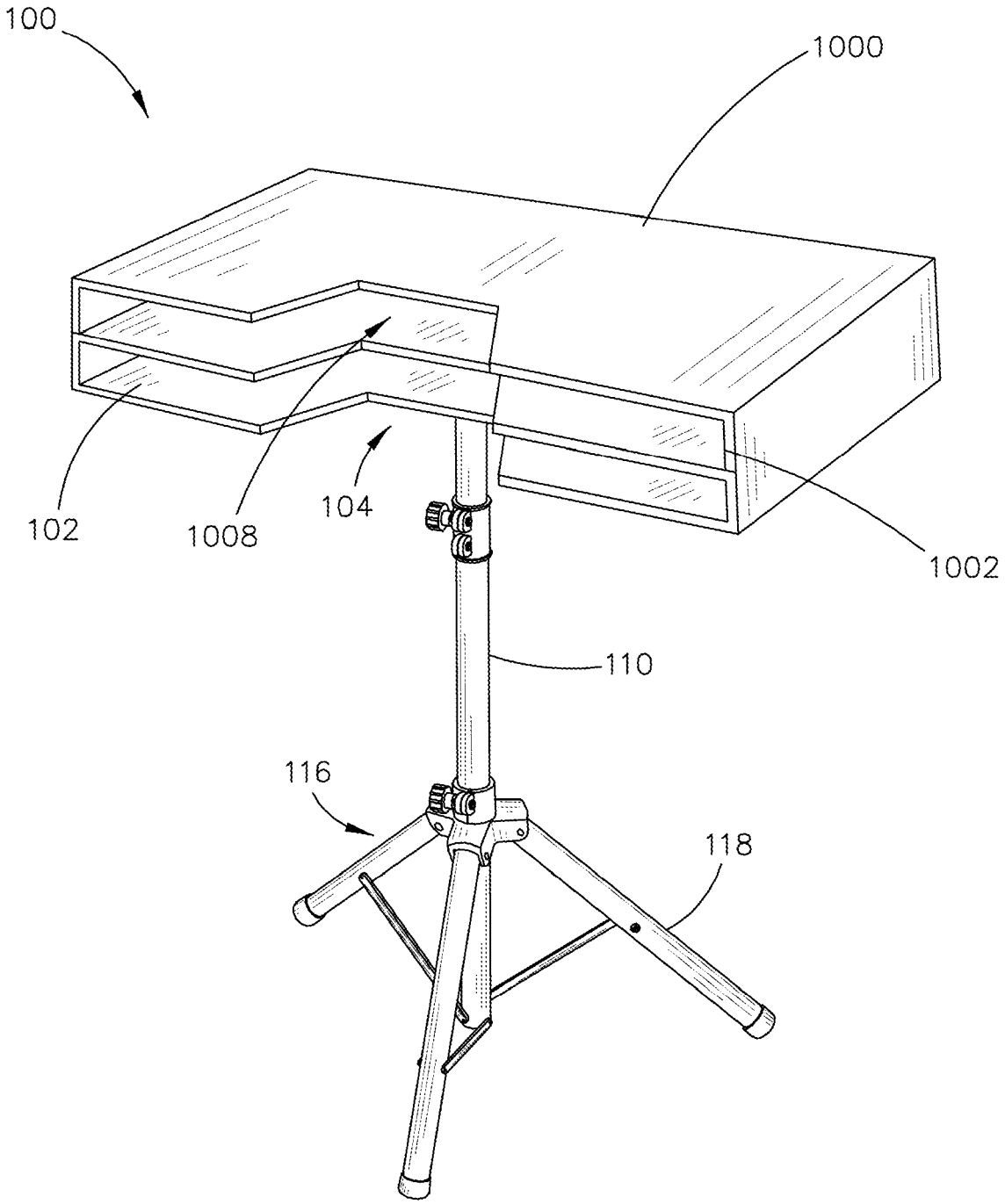
FIG. 10 illustrates a perspective view of a mobile color and style application device, in accordance with one or more embodiments of the present disclosure.

Referring to FIGS. 10-14, in embodiments, the device 100 includes one or more risers 1000 configured to contain and hold a section of hair. As shown in FIGS. 10-12, the one or more risers 1000 may include one or more sides 1002 configured to couple to a portion of the one or more platforms 102. For example, a first riser **1000*a* of the one or more risers 1000 may be configured to couple to a platform 102 (e.g., a base platform 102). For instance, as shown in FIG. 11, the one or more sides 1002 of the one or more risers 1000 may include one or more protrusions 1004 configured to couple to one or more holes 1006 on the one or more platforms 102 and/or the one or more risers 1000. In this regard, the shape of the one or more holes may be complementary to the shape of the one or more protrusions 1004**.

In another instance, as shown in FIG. 13, the one or more risers 1000 may include one or more protrusions 1004 configured to couple to an adjacent protrusion on the one or more platforms 102 and/or the one or more risers 1000.

In another instance, as shown in FIG. 14, the one or more risers 1000 may couple to a portion of the adjustable tower 110 such that the one or more risers 1000 are positioned a select distance from an adjacent base platform 102 and/or an adjacent riser 1000. In this regard, the adjustable tower 110 may include one or more grooves configured to engage a portion of the one or more risers 1000 and/or the one or more platforms 102, such that the height of such may be adjusted.

In some embodiments, the one or more platforms 102 may be coupled to a variety of one or more risers in order to allow the platforms to be placed in a desired orientation. For example, the one or more platforms 102 may be coupled to one or more risers with varying heights and/or angles.

It is noted herein that the one or more sides 1002, the one or more protrusions 1004, and/or the one or more risers 1000 may be any height suitable for a variety of clients and/or stylists. For example, the one or more sides 1002, the one or more protrusions 1004, and/or the one or more risers 1000 may have a height between 0.25-4.00 inches. For instance, the one or more sides 1002, the one or more protrusions 1004, and/or the one or more risers 1000 may have a height of 2.00 inches. In an example embodiment, with installation of two risers and one base platform, a height of the mobile color and style application device 100 may adjust from 31"-46".

It is further noted herein that a riser may be sized of a different dimension than the first platform for improved access to the user's hair and for improved comfort for the user. While two risers are shown, it is noted herein that the riser may be optional, and one, three, up to an N number of risers may be employed without departing from the scope and intent of the present disclosure.

It is noted herein that a back side may not be included one the one or more risers 1000; however, in other embodiments, a back cover may be provided. The back cover may allow substantial covering whereby 75 percent of the area is enclosed. If a heat source is used, such as a hair dryer, this may contain the heat and provide additional thermal capacity. The unique, incubated design of the risers support an additional variable of heat that in conjunction with foil may aid in higher levels of lift that may not be achieved with basic balayage and open-air processing, due to simple, yet significant rules of hair color.

Figure 7:
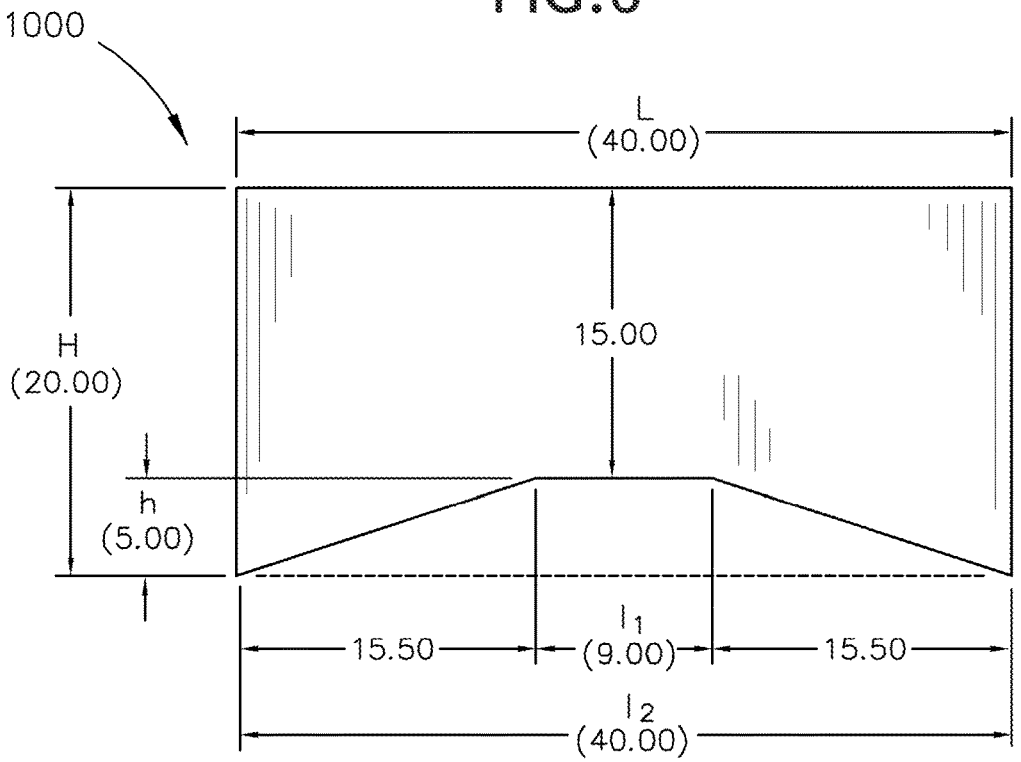
FIG. 7 illustrates a simplified top down view of a riser of a mobile color and style application device, in accordance with one or more embodiments of the present disclosure.

The one or more risers 1000 may be any dimension suitable for containing and holding a section of hair. For example, as shown in FIG. 7, the one or more risers 1000 may be 40.00"×20.00" (e.g., have a length L of 40.00 inches and a height H of 20.00 inches). The one or more risers 1000 may include one or more riser cut-outs 1008 configured to conform to a portion of a neck or a head of a user. For example, the one or more riser cut-outs 1008 may be configured to conform to a curve of the neck or the head of user. The one or more riser cut-outs 1008 may be any shape and/or dimension known in the art. For example, as shown in FIG. 7, the one or more riser cut-outs 1008 may be trapezoidal with a first length $l_1$ of 9.00 inches, a second length $l_2$ of 40.00 inches, and a height h of 5.00 inches.

Figure 15:
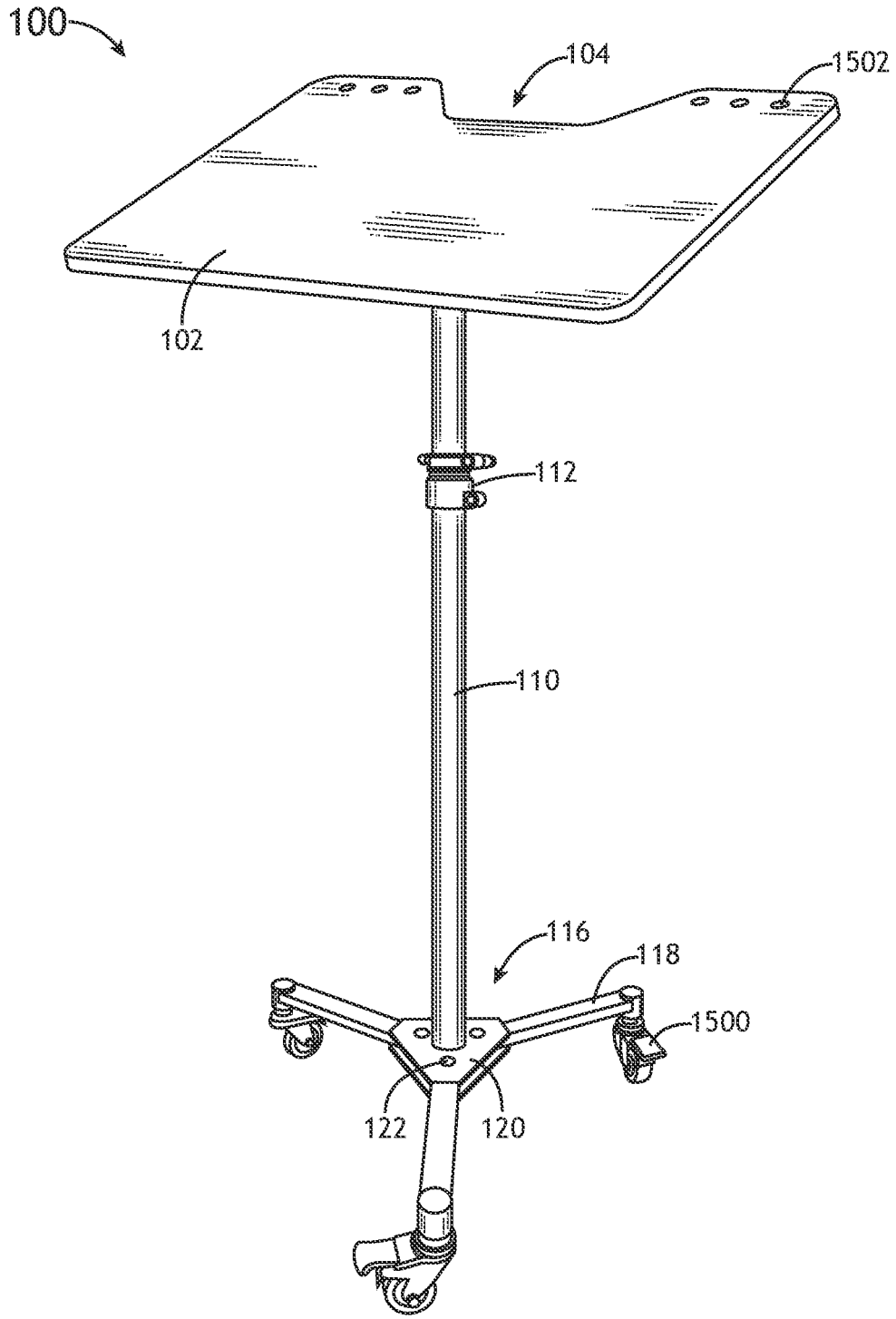
FIG. 15 illustrates a perspective view of a mobile color and style application device, in accordance with one or more embodiments of the present disclosure.

Referring to FIG. 15, the base 116 may include one or more lockable wheels 1500 configured to secure the device in a fixed position. For example, the base 116 may include one or more legs 118 configured to couple to one or more lockable wheels 1500. For instance, the base 116 may include a plurality of vertical legs 118 (e.g., three or more vertical legs), where each vertical leg 118 is coupled to a lockable wheel 1500. In this regard, the base 116 may include three or more lockable wheels 1500. The plurality of vertical legs may couple to the vertical tower via any mechanism. For example, the plurality of vertical legs 118 may couple to the adjustable tower 110 via one or more couplers 120 including one or more leg joints 1222. The one or more leg joints 122 may be configured to receive a portion of the plurality of vertical legs 118. It is noted herein that the one or more couplers 120 including the one or more leg joints 122 may be coupled to the one or more legs 118 via any fastening mechanism known in the art including, but not limited to, one or more screws, one or more bolts, tension fit, welding, adhesives, or the like.

In some embodiments, as discussed previously herein, the base may include a tripod base including three legs (e.g., tripod legs). The tripod base may include three or more lockable wheels configured to secure the device in a fixed position. For example, each leg of the tripod base may be coupled to a lockable wheel.

The one or more lockable wheels may be coupled to a portion of the base via any mechanism known in the art.

Referring to FIG. 15, the one or more platforms 102 may include one or more holes 1502. For example, the one or more platforms 102 may include one or more holes 1502 configured to receive a portion of an accessory or other external device. In one instance, the one or more holes 1502 may be configured to receive a handle of a color brush. In another instance, the one or more holes 1502 may be configured to receive a handle of a hair brush/comb. In another instance, the one or more holes may be configured to receive a cord of a hair styling tool (e.g., curling iron, flat iron, hair dryer, or the like).

It is noted that the one or more platforms 102 may include any number of holes that are any size and shape. For example, as shown in FIG. 15, the one or more platforms 102 may include three circular holes 1502 on a first side of the one or more platforms 102 and three additional circular holes 1502 on a second side of the one or more platforms 102.

Further, it is noted that the one or more holes 1502 may be arranged at any location on the one or more platforms 102. For example, the one or more holes 1502 may be arranged such that the one or more holes 1502 (including the one or more accessories) do not interfere with the placement of the hair when on the platform 102. In one instance, the one or more holes 1502 may be arranged in the right-hand corner of the one or more platforms 102. In this regard, a first set of three holes 1502 may be arranged in the right-hand corner of the one or more platforms 102. In another instance, the one or more holes 1502 may be arranged in the left-hand corner of the one or more platforms 102. In this regard, a first set of three holes 1502 may be arranged in the left-hand corner of the one or more platforms 102.

Figure 16A:
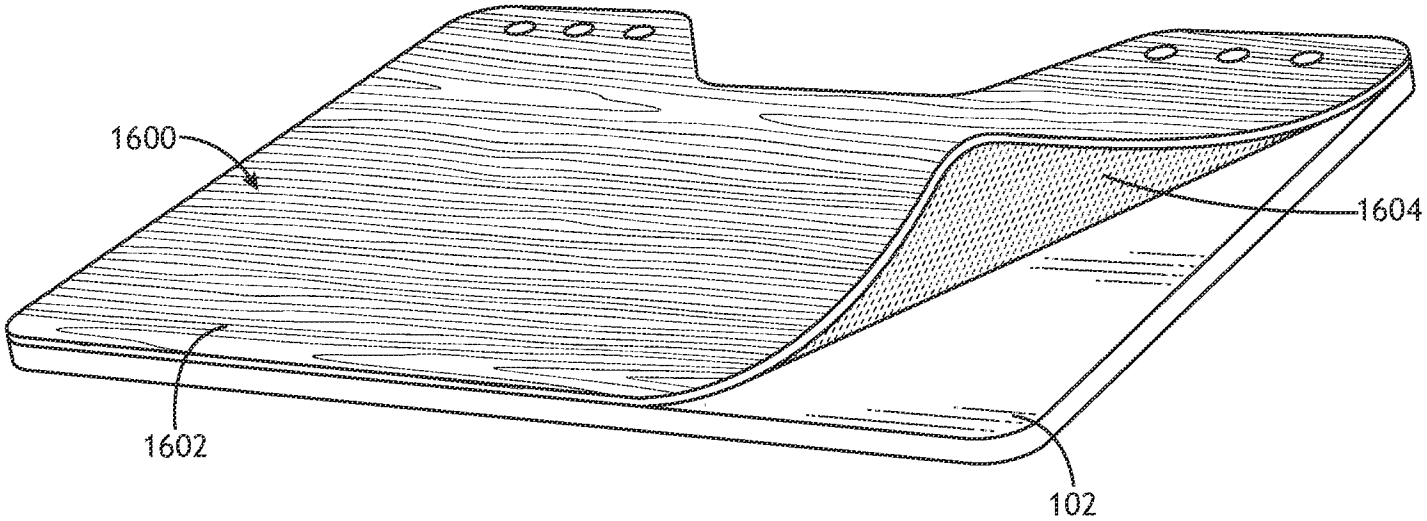
FIG. 16A illustrates a perspective view of a removable overlay of a mobile color and style application device, in accordance with one or more embodiments of the present disclosure.
Figure 16B:
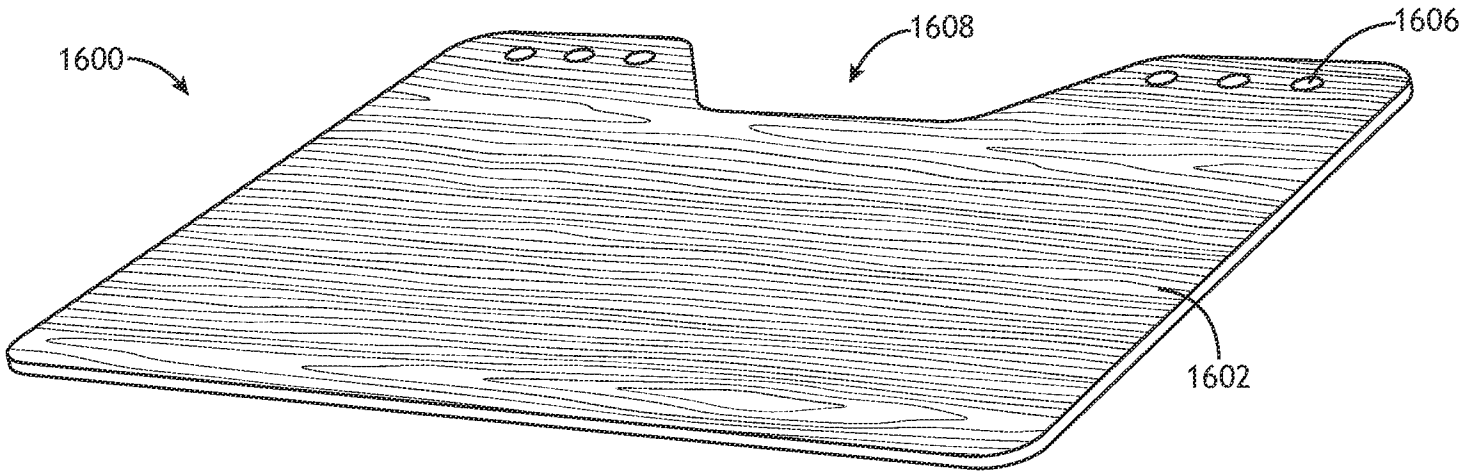
FIG. 16B illustrates a perspective view of a removable overlay of a mobile color and style application device, in accordance with one or more embodiments of the present disclosure.
Figure 16C:
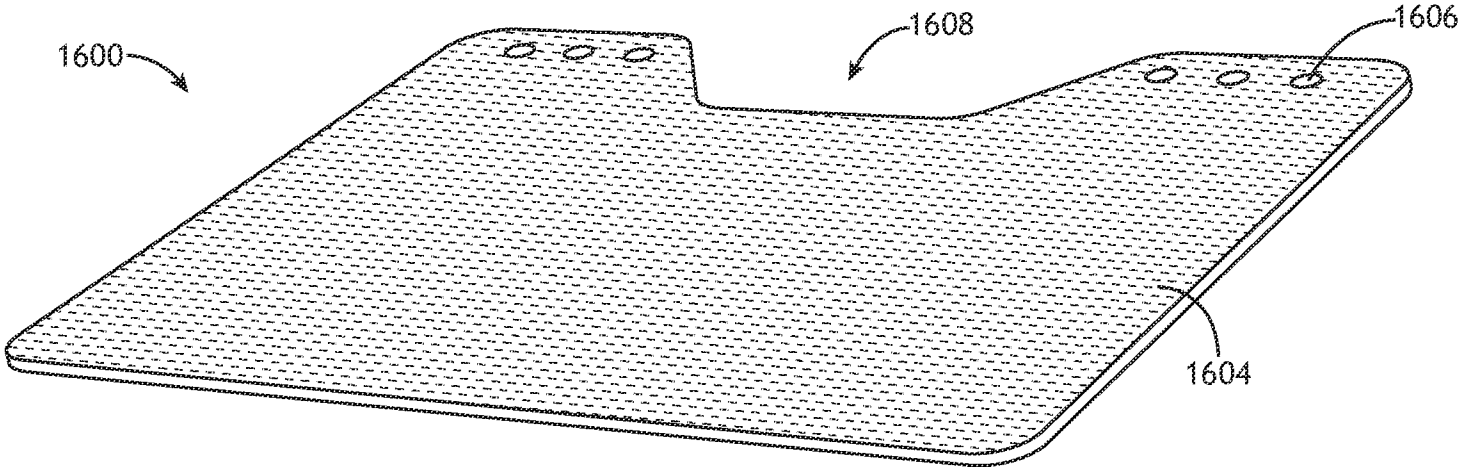
FIG. 16C illustrates a perspective view of a removable overlay of a mobile color and style application device, in accordance with one or more embodiments of the present disclosure.
Figure 17A:
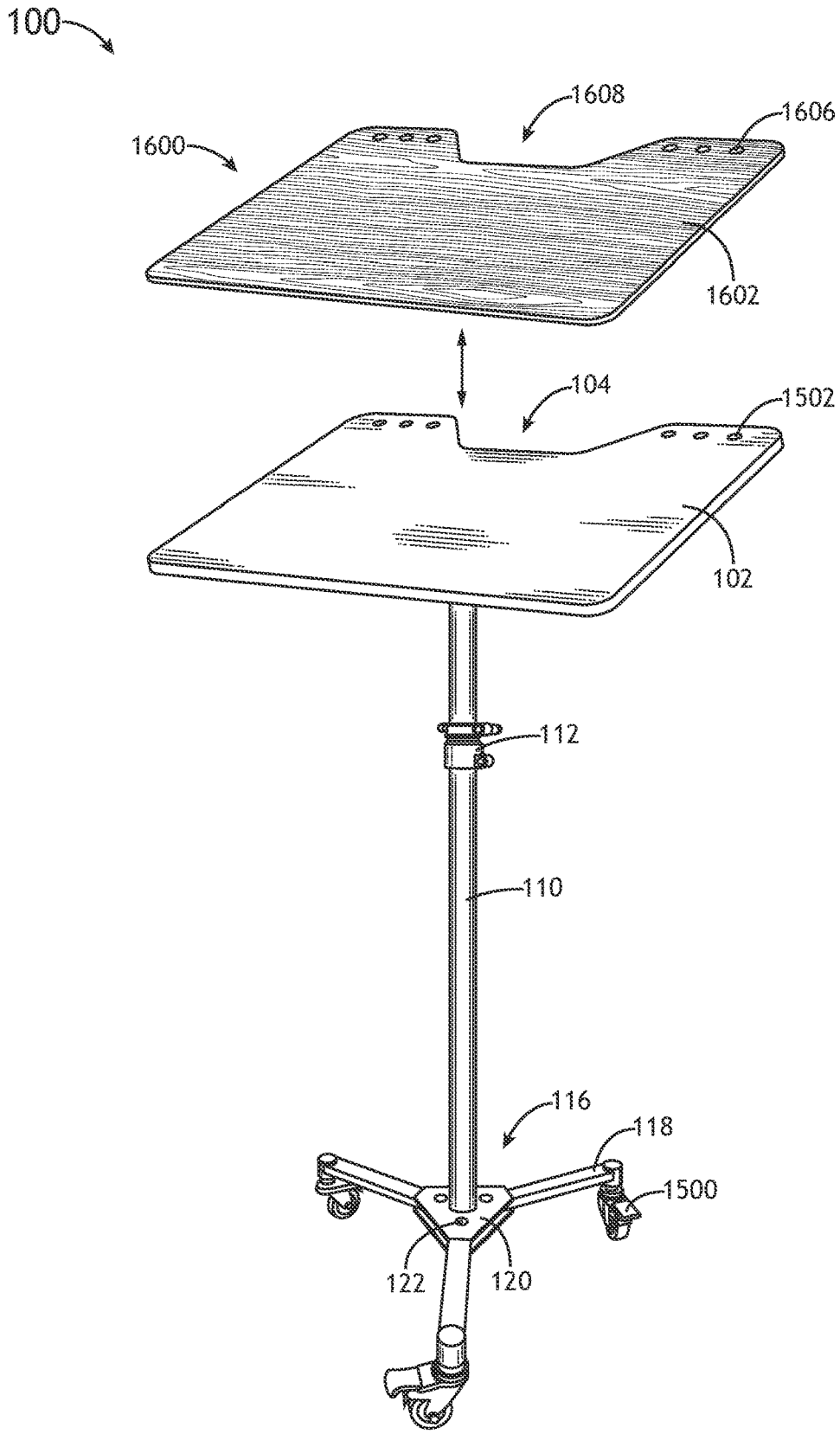
FIG. 17A illustrates an exploded view of a mobile color and style application device, in accordance with one or more embodiments of the present disclosure.
Figure 17B:
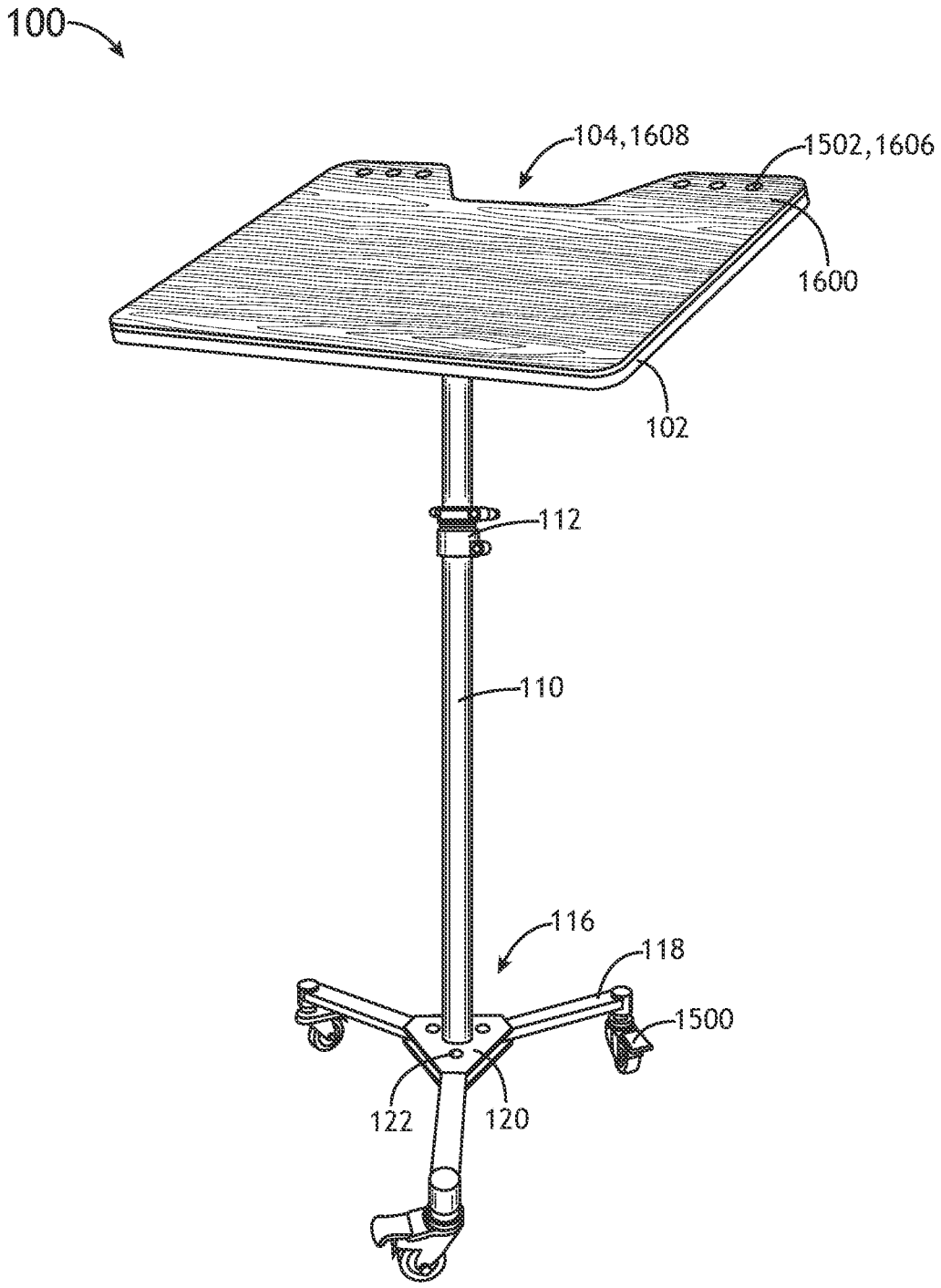
FIG. 17B illustrates a perspective view of a mobile color and style application device, in accordance with one or more embodiments of the present disclosure.

Referring to FIGS. 16A-16C, the one or more platforms 102 may be configured to couple to a removable overlay 1600.

The removable overlay 1600 may include one or more graphical representations on a surface 1602 of the removable overlay 1600. For example, the removable overlay 1600 may include one or more pieces of artwork, one or more logos, one or more symbols, one or more phrases, one or more designs, or the like. In this regard, when a user wants to change out the one or more graphical representations of the device, the user may remove the removable overlay 1600 and replace the removable overlay 1600 with an additional removable overlay including an additional graphical representation on the surface 1602 of the removable overlay 1600. This allows for the user to swap out the removable overlay 1600, instead of swapping out the platform as a whole.

The one or more platforms 102 may couple to the removable overlay 1600 via any mechanism.

In some embodiments, as shown in FIGS. 16A-16C, the one or more platforms 102 may couple to the removable overlay 1600 via a suction connection mechanism. For example, the one or more platforms 102 may couple to the removable overlay 1600 via nano-suction connection mechanism. For instance, a surface of the one or more platforms 102 may include one or more nano-suction cups configured to couple to a surface 1604 of the removable overlays 1600. In this instance, the removable overlay 1600 may be formed of a material capable of creating a seal between the one or more suction cups of the one or more platforms and the surface 1604 of the removable overlay.

By way of another example, a surface of the one or more platforms may include one or more suction cups configured to couple to a surface of the removable overlays. In this instance, the removable overlay 1600 may be formed of a material capable of creating a seal between the one or more suction cups of the one or more platforms and the surface 1604 of the removable overlay.

In some embodiments, the one or more platforms 102 may couple to the removable overlay 1600 via one or more magnetic connection mechanisms. For example, at least a portion of the one or more platforms 102 may be magnetic (e.g., covered in a magnetic coating/film or at least partially formed of a magnetic material). In one instance, a surface of the removable overlay 1600 (e.g., surface 1604) may be magnetic, such that the magnetic surface of the overlay may couple to the magnetic surface of the one or more platforms 102. In another instance, a surface of the removable cover may be non-magnetic and one or more magnets may be used to magnetically attached the removable overlay to the magnetic surface of the one or more platforms.

In some embodiments, the one or more platforms 102 may couple to the removable overlay 1600 via one or more fasteners (e.g., clips). For example, the one or more fasteners may be configured to couple the removable overlay to the one or more platforms.

In some embodiments, the one or more platforms may couple to the removable overlay via one or more hook and loop fasteners. For example, the one or more hook and loop fasteners may be configured to couple the removable overlay to the one or more platforms.

The removable overlay 1600 may include one or more holes 1606 that are complementary to the one or more holes 1502 on the one or more platforms 102, as discussed previously with respect to FIG. 15. For example, the one or more holes 1606 may be arranged in the right-hand corner of the removable overlay 1600, such that the one or more holes 1606 are complementary to the one or more holes 1502 arranged in the right-hand corner of the one or more platforms 102. By way of another example, the one or more holes 1606 may be arranged in the left-hand corner of the removable overlay 1600, such that the one or more holes 1606 are complementary to the one or more holes 1502 arranged in the left-hand corner of the one or more platforms 102.

The removable overlay 1600 may include one or more cut-outs 1608 that are complementary to the one or more cut-outs 104 of the one or more platforms 102. The one or more cut-outs 1608 may be configured to conform to a portion of at least one of a head or a neck of a user. For example, the one or more cut-outs 1608 may be configured to conform to a curve of the neck or a curve of the head of a user. For instance, as shown in FIGS. 15-17C, the one or more cut-outs 1608 may be trapezoidal (or substantially trapezoidal).

The removable overlay 1600 may be formed of any material and fabricated using any technique. For example, the removable overlay 1600 may be formed of a flexible, synthetic material such as, but not limited to, PVC plastic, rubber, neoprene. Further, the removable overlay 1600 may be formed of a flexible, synthetic material such as, but not limited to, PVC plastic, rubber, neoprene including an adhesive magnetic layer on a bottom surface 1604 of the removable overlay.

Figure 18A:
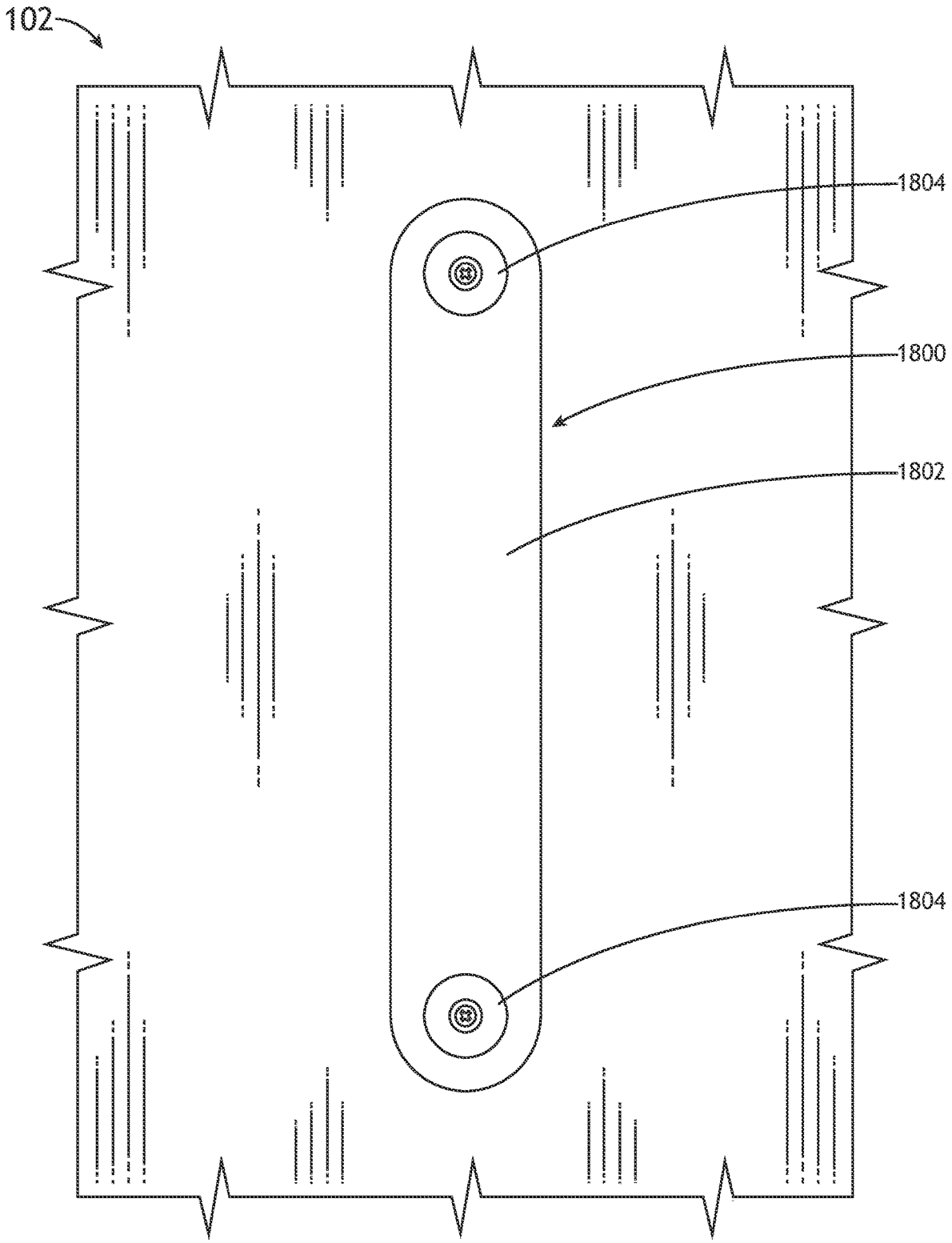
FIG. 18A illustrates a detailed view of one or more magnetic connections of a mobile color and style application device, in accordance with one or more embodiments of the present disclosure.
Figure 18B:
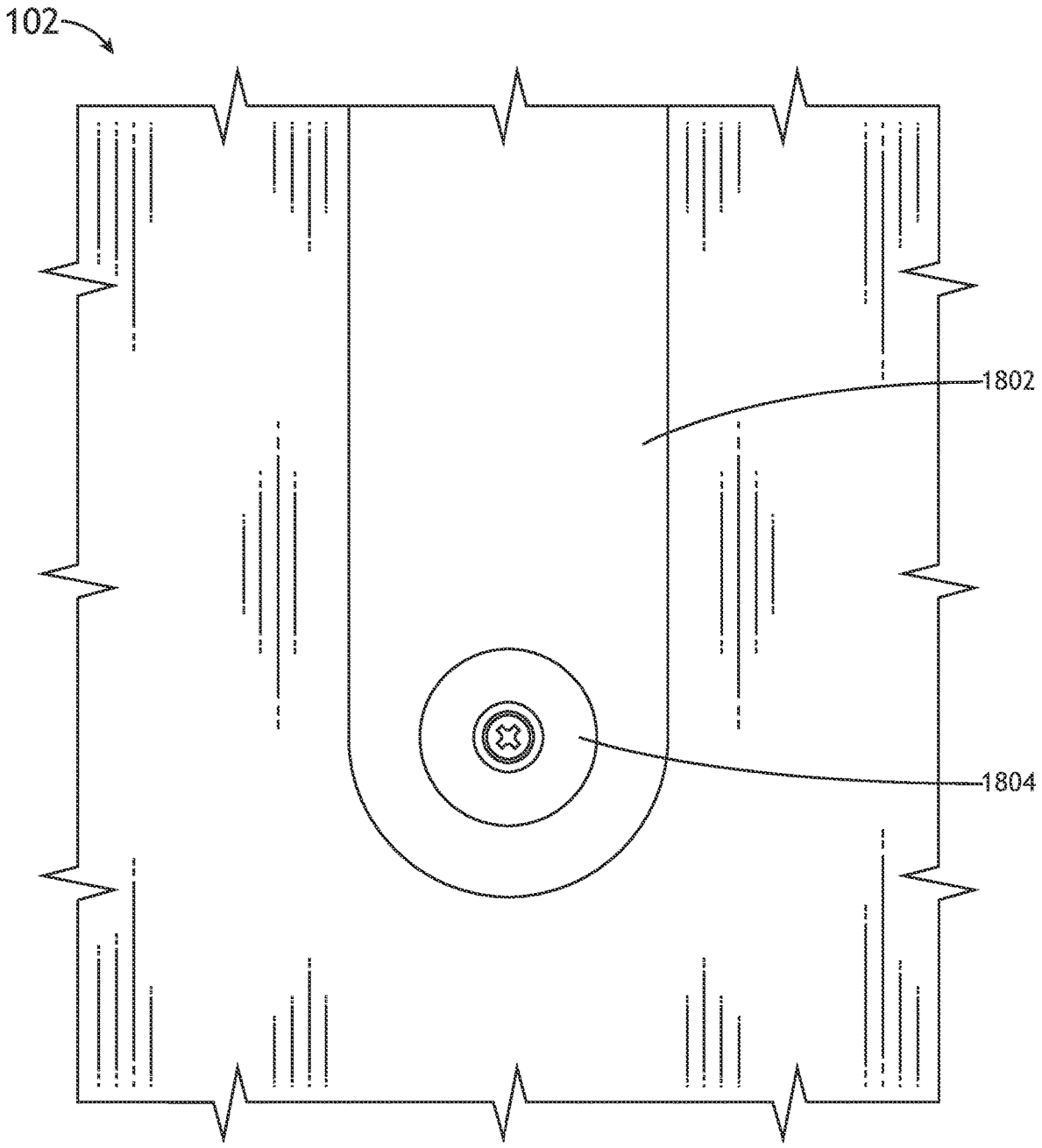
FIG. 18B illustrates a detailed view of one or more magnetic connections of a mobile color and style application device, in accordance with one or more embodiments of the present disclosure.

Referring to FIGS. 18A-18B, the one or more platforms 102 may be coupled to the one or more plates 106 via a magnetic connection mechanism 1800 including one or more magnetic connections 1802 (e.g., magnets), as discussed previously with respect to FIG. 3. The one or more magnetic connections 1802 may be configured to couple the one or more platforms 102 to the one or more plates 106 may be affixed to a portion of the one or more platforms 102 via any mechanism. For example, one or more magnets 1802 may be affixed to a bottom surface of the one or more platforms 102 via one or more fasteners 1804 (e.g., screws, or the like). In this regard, the one or more platforms 102 may include one or more fastener holes and the one or more magnets may include one or more holes. The one or more fastener holes may be configured to receive a portion of the one or more fasteners 1804, such that the one or more magnets 1802 are secured to the bottom surface by fastening the fasteners to the one or more holes (e.g., by screwing the screws into the one or more screw holes on the platform). By way of another example, one or more magnets 1802 may be affixed to a bottom surface of the one or more platforms 102 via one or more adhesives (e.g., glue, or the like).

In some embodiments, the one or more platforms 102 may be configured to couple to one or more decals (or stickers). For example, the one or more platforms 102 may be configured to couple to one or more static decals (or stickers). In this regard, the one or more platforms 102 may be formed of a material capable of creating a static connection with a surface of the one or more static decals, such that the one or more static decals may couple to the one or more platforms 102 via static electricity. By way of another example, the one or more platforms 102 may be configured to couple to one or more magnetic decals (or stickers). In this regard, the one or more platforms 102 may be formed of a magnetic material capable of creating a magnetic connection with a surface of the one or more magnetic decals, such that the one or more magnetic decals may couple to the one or more platforms 102 via a magnetic connection. It is noted that the one or more decals may couple to a portion of the one or more platforms 102 via any coupling mechanism (e.g., magnetic connection, adhesives, hook and loop fasteners, static connection, a suction mechanism, or the like). As such, the above examples are provided merely for illustrative purposes and shall not be construed as limiting the scope of the present disclosure.

In some embodiments, the removable overlay 1600 of the one or more platforms 102 may be configured to couple to one or more decals (or stickers). For example, the removable overlay 1600 may be configured to couple to one or more static decals (or stickers). In this regard, the removable overlay 1600 may be formed of a material capable of creating a static connection with a surface of the one or more static decals, such that the one or more static decals may couple to the removable overlay 1600 via static electricity. By way of another example, the removable overlay 1600 may be configured to couple to one or more magnetic decals (or stickers). In this regard, the one or more platforms 102 or the removable overlay 1600 may be formed of a magnetic material capable of creating a magnetic connection with a surface of the one or more magnetic decals, such that the one or more magnetic decals may couple to the one or more platforms 102 or the removable overlay 1600 via a magnetic connection. It is noted that the one or more decals may couple to a portion of the one or more removable overlays 1600 via any coupling mechanism (e.g., magnetic connection, adhesives, hook and loop fasteners, static connection, a suction mechanism, or the like). As such, the above examples are provided merely for illustrative purposes and shall not be construed as limiting the scope of the present disclosure.

The or more decals/stickers may include one or more pieces of artwork, one or more logos, one or more symbols, one or more phrases, one or more designs, or the like. In this regard, when a user wants to change the aesthetics of the device, the user may apply one or more decals/stickers to a portion of the platform and/or remove one or more decals/sticks from the platform.

As discussed previously herein, the one or more platforms 102 may be any dimension suitable for color application. For example, the one or more platforms may be 21.00"×30.00" (e.g., have a length L of 21.00 inches and a height of 30.00 inches) or 30.00"×21.00" e.g., have a length L of 30.00 inches and a height of 21.00 inches). It is noted herein that the shape and dimensions of the one or more platforms 102 may be adjusted to apply a particular service to a particular client. For example, a larger platform may be used with a client with longer hair and a shorter platform may be used with a client with shorter hair.

It is noted herein that the mobile color and style application device 100 may have a number advantages. For example, the device 100 may allow for more efficient hair sectioning and more uniform sections. By way of another example, the device 100 may be allow for controlled tension over an entire section of hair for even application of color. By way of a further example, the device 100 may allow for flexible and versatile color control by providing a secure hard surface to use with both hands. By way of a further example, the device 100 allows for the ability to cross check work and manipulate color for superior color blending. By way of a further example, the device 100 allows for a significant reduction in application time. By way of a further example, the device 100 allows for a number of on-board processing options or non-board processing options to allow for natural distribution of hair. By way of a further example, the device 100 allows for improved hair lift with the option of foil use on the platform.

Another advantageous aspect of the mobile cart and style device is the storage capability. The base, tower, platform, and risers may be easily installed and uninstalled to allow easy mobility and storage of the products. Because the platform and risers may be constructed of lightweight materials, they may be hung on a wall for easy storage and access.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

The previous description is presented to enable one of ordinary skill in the art to make and use the invention as provided in the context of a particular application and its requirements. As used herein, directional terms such as "top," "bottom," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., " a device having at least one of A, B, and C" would include but not be limited to devices that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a device having at least one of A, B, or C" would include but not be limited to devices that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A mobile color and style application device, comprising:

a base, wherein the base includes one or more legs, wherein the one or more legs include one or more lockable wheels;

an adjustable tower, wherein the adjustable tower is coupled to the base, wherein the adjustable tower includes one or more tower locks configured to adjust a vertical height of the adjustable tower;

a plate, wherein the plate is coupled to the adjustable tower, wherein the plate includes one or more plate locks configured to adjust a tilt angle of the plate;

one or more platforms, wherein the one or more platforms are configured to couple to a portion of the plate via a quick-connect coupling mechanism, wherein the one or more platforms include one or more cut-outs, wherein the one or more cut-outs are configured to conform to a portion of at least one of a neck or a head of a user, the quick-connect coupling mechanism including one or more magnetic connectors, the one or more platforms including a recessed area on a bottom surface of the one or more platforms, the one or more platforms including the one or more magnetic connectors in the recessed area of the bottom surface of the one or more platforms; and a removable overlay configured to removably couple to a portion of the one or more platforms.

2. The device of claim 1, wherein the removable overlay is configured to removably couple to a portion of the one or more platforms via one or more magnetic connection mechanisms.

3. The device of claim 1, wherein the removable overlay is configured to removably couple to a portion of the one or more platforms via one or more suction connection mechanisms.

4. The device of claim 1, wherein the one or more platforms include one or more holes configured to receive one or more accessories.

5. The device of claim 1, wherein the recessed area of the bottom surface of the one or more platforms has a shape that is complementary to a shape of the plate.

6. A mobile color and style application device, comprising:

a base, wherein the base includes one or more vertical legs, wherein the one or more legs include one or more lockable wheels;

an adjustable tower, wherein the adjustable tower is coupled to the base, wherein the adjustable tower includes one or more tower locks configured to adjust a vertical height of the adjustable tower;

a plate, wherein the plate is coupled to the adjustable tower, wherein the plate includes one or more plate locks configured to adjust a tilt angle of the plate;

one or more platforms, wherein the one or more platforms are configured to couple to a portion of the plate via a quick-connect coupling mechanism, wherein the one or more platforms include one or more cut-outs, wherein the one or more cut-outs are configured to conform to a portion of at least one of a neck or a head of a user, the quick-connect coupling mechanism including one or more magnetic connectors, the one or more platforms including a recessed area on a bottom surface of the one or more platforms, the one or more platforms including the one or more magnetic connectors in the recessed area of the bottom surface of the one or more platforms, wherein the one or more platforms include one or more holes configured to receive one or more accessories; and a removable overlay configured to removably couple to a portion of the one or more platforms.

7. The device of claim 6, wherein the removable overlay is configured to removably couple to a portion of the one or more platforms via one or more magnetic connection mechanisms.

8. The device of claim 6, wherein the removable overlay is configured to removably couple to a portion of the one or more platforms via one or more suction connection mechanisms.

9. The device of claim 6, wherein the removable overlay includes one or more holes arranged complementary to the one or more holes of the one or more platforms.

10. The device of claim 6, wherein the removable overlay includes one or more cut-outs arranged complementary to the one or more cut-outs of the one or more platforms.

11. The device of claim 6, wherein the recessed area of the bottom surface of the one or more platforms has a shape that is complementary to a shape of the plate.

12. A mobile color and style application device, comprising:

a base, wherein the base includes one or more legs, wherein the one or more legs include one or more lockable wheels;

an adjustable tower, wherein the adjustable tower is coupled to the base, wherein the adjustable tower includes one or more tower locks configured to adjust a vertical height of the adjustable tower;

a plate, wherein the plate is coupled to the adjustable tower, wherein the plate includes one or more plate locks configured to adjust a tilt angle of the plate; and one or more platforms, wherein the one or more platforms are configured to couple to a portion of the plate via a quick-connect coupling mechanism, wherein the quick-connect coupling mechanism includes one or more magnetic connectors, wherein the one or more platforms include a recessed area on a bottom surface of the one or more platforms, wherein the one or more platforms include the one or more magnetic connectors in the recessed area of the bottom surface of the one or more platforms.

13. The device of claim 12, further comprising:

a removable overlay configured to removably couple to a portion of the one or more platforms.

14. The device of claim 13, wherein the removable overlay is configured to removably couple to a portion of the one or more platforms via one or more magnetic connection mechanisms.

15. The device of claim 13, wherein the removable overlay is configured to removably couple to a portion of the one or more platforms via one or more suction connection mechanisms.

16. The device of claim 12, wherein the one or more platforms include one or more holes configured to receive one or more accessories.

17. The device of claim 12, wherein the tilt angle of the plate is between 30-60 degrees.

18. The device of claim 12, wherein a portion of the one or more platforms is formed of at least one of:

glass, acrylic, melamine, vinyl, wood, or metal.

19. The device of claim 12, wherein the recessed area of the bottom surface of the one or more platforms has a shape that is complementary to a shape of the plate.

* * * * *